US005915526A

United States Patent [19]

Dewees et al.

[11] Patent Number: 5,915,526

[45] Date of Patent: Jun. 29, 1999

[54] SAFETY APPARATUS FOR IN-LINE CAPPING MACHINE

[75] Inventors: Thomas Gerret Dewees, Pleasanton; Jerry A. Volponi, Livermore, both of Calif.

[73] Assignee: The Clorox Company, Oakland, Calif.

[21] Appl. No.: 08/633,416

[22] Filed: Apr. 17, 1996

Related U.S. Application Data

[63] Continuation of application No. 08/491,398, Jun. 19, 1995, abandoned.

[51] Int. Cl.[6] ..... B65B 57/00; B67B 3/20

[52] U.S. Cl. ..... 198/832.2; 198/860.3; 53/77; 53/314

[58] Field of Search ..... 198/464.1, 463.4, 198/832, 832.2, 817, 810.01, 860.3; 53/77, 313, 314, 389.5, 398.1

[56] References Cited

U.S. PATENT DOCUMENTS

| | | | |
|---|---|---|---|
| 1,172,447 | 2/1916 | Forte | 53/331.5 |
| 2,732,991 | 1/1956 | De Bastos et al. | 53/314 |
| 2,734,672 | 2/1956 | Day et al. | 226/88 |
| 2,829,479 | 4/1958 | Cooper | 53/331.5 |
| 2,909,879 | 10/1959 | Hohl et al. | 53/331.5 |
| 2,942,394 | 6/1960 | Bjering et al. | 53/314 |
| 3,001,341 | 9/1961 | Wing | 53/77 X |
| 3,018,597 | 1/1962 | Hohl | 53/314 |
| 3,111,798 | 11/1963 | Weller | 53/306 |
| 3,125,020 | 3/1964 | Surina | 53/77 X |
| 3,214,887 | 11/1965 | Weller | 53/316 |
| 3,435,587 | 4/1969 | Weller | 53/317 |
| 3,522,690 | 8/1970 | Zetterberg | 53/331.5 |
| 3,623,292 | 11/1971 | Barnes | 53/331.5 |
| 3,701,414 | 10/1972 | Mayer et al. | 198/832.2 |
| 3,849,973 | 11/1974 | Zetterberg | 53/331.5 |
| 3,882,657 | 5/1975 | Fischbein et al. | 53/77 |
| 3,905,177 | 9/1975 | Herzog | 53/314 |
| 3,986,323 | 10/1976 | Aidlin et al. | 53/331.5 X |
| 4,079,573 | 3/1978 | Livingston et al. | 53/77 |
| 4,199,914 | 4/1980 | Ochs et al. | 53/314 |
| 4,249,397 | 2/1981 | Guerra | 64/29 |
| 4,279,115 | 7/1981 | Roberts et al. | 53/314 |
| 4,525,980 | 7/1985 | Ulrich et al. | 53/77 X |
| 4,559,760 | 12/1985 | Daniels et al. | 53/314 |
| 4,561,234 | 12/1985 | Tonus | 53/77 X |
| 4,658,565 | 4/1987 | Westbrook et al. | 53/308 |
| 4,662,153 | 5/1987 | Wozniak | 53/331.5 |
| 4,685,269 | 8/1987 | Marchetti | 53/77 X |
| 5,054,260 | 10/1991 | Herzog | 53/307 |
| 5,195,737 | 3/1993 | Ifkovits, Jr. et al. | 198/317 X |
| 5,284,001 | 2/1994 | Ochs | 53/307 |
| 5,423,159 | 6/1995 | Bankuty et al. | 53/331.5 X |

*Primary Examiner*—Horace M. Culver
*Attorney, Agent, or Firm*—Burns, Doane, Swecker & Mathis, LLP

[57] ABSTRACT

A straight line capping machine is provided that wherein the cap tightening discs and the container grasping mechanism are synchronized to a predetermined relationship so as to prevent cocked caps, loose caps and/or scuffed caps. In particular, the mechanisms are synchronized to ensure that the tangential velocity of the rear cap tightening disc minus the tangential velocity of the front cap tightening disc is about twice the predetermined velocity of the container passing through the capping machine.

4 Claims, 25 Drawing Sheets

SAFETY APPARATUS FOR IN-LINE CAPPING MACHINE

This is a continuation application of U.S. application Ser. No. 08/491,398, filed Jun. 19, 1995 and now abandoned.

BACKGROUND OF THE INVENTION

1. Field of the Invention

The present invention relates to container sealing machines for applying caps to containers, particularly to a high speed in-line (i.e., straight line) capping machine.

2. State of the Art:

Straight line sealing machines for sealing containers have been in use for many years. These machines are generally characterized by having a horizontal moving conveyor which carries filled and unsealed containers successively past a cap feeding device, a cap applicator device, and a cap sealing device. Although the known machines have proven capable of providing satisfactory operations, these prior machines have consistently shown an inability to prevent cocked caps and/or loose caps without scuffing of the cap outer surfaces.

U.S. Pat. No. 3,905,177 (Herzog) issued Sep. 16, 1975 discloses a bottle capping machine in which caps from a hopper are received by each bottle as the bottle passes by, the bottles are then moved between two belts that move at the same rate of speed as the conveyor belt. The two belts prevent the bottle from rotating as it passes between two rows of oppositely rotating wheels that turn the caps down on the bottle. The bottle grasping belts disclosed in Herzog are not synchronized with the rotating wheels.

U.S. Pat. No. 4,559,760 (Daniels et al.) issued Dec. 24, 1985 and U.S. Pat. No. 4,279,115 (Roberts et al.) issued Jul. 21, 1981 disclose capping machines that are provided with height and width adjustments. Both height and width adjustments can be made for containers and closures of different sizes. These capping machines use an endless belt that contacts the top of the closure (i.e., lid) in an off-center fashion to rotate the lid onto the container.

SUMMARY OF THE INVENTION

The present invention provides a straight line capping machine that provides desirable characteristics in a straight line capping machine while overcoming the disadvantages of prior art devices. In the straight line capping machine of the present invention, the cap tightening discs and the container grasping mechanism are synchronized to a predetermined relationship so as to prevent cocked caps, loose caps and/or scuffed caps. In particular, the mechanisms are synchronized to ensure that the tangential velocity of the rear cap tightening disc minus the tangential velocity of the front cap tightening disc is about twice the predetermined velocity of the container passing through the capping machine.

In one embodiment of the invention, there is provided a straight line capping apparatus having a container conveyor for moving each container through the apparatus at a predetermined velocity and for use with a cap feeding mechanism for placing a cap on each container. The apparatus comprises a first cap tightening disc located downstream of the cap feeding mechanism and above the container conveyor, a second cap tightening disc spaced from the first cap tightening disc so as to receive the cap on each container therebetween whereby when the container with the cap thereon passes between the first and second cap tightening discs the cap is spun down on the container. A container grasping mechanism prevents rotation of the container as it passes between the first and second cap tightening discs. The first cap tightening disc, the second cap tightening disc and the container grasping mechanism are synchronized to ensure that the tangential velocity of the second cap tightening disc is equal to about the tangential velocity of the first cap tightening disc plus two times the predetermined velocity of the container moving through the apparatus.

In one of its method aspects, the present invention provides a method of tightening a cap onto a container in a straight line capping apparatus having a container conveyor for moving each container through the apparatus at a predetermined velocity. The method comprises placing the cap on each container, moving each container through the apparatus on the container conveyor, and grasping each container with a container grasping mechanism to prevent rotation of the container as it passes between a first cap tightening disc and a second cap tightening disc spaced from each other so as to receive the cap on each container therebetween whereby when the container with the cap thereon passes between the first and second cap tightening discs the cap is spun down on the container. The method further comprises synchronizing the first cap tightening disc, the second cap tightening disc and the container grasping mechanism to ensure that the tangential velocity of the second cap tightening disc is equal to about the tangential velocity of the first cap tightening disc plus two times the predetermined velocity of the container passing through the apparatus.

BRIEF DESCRIPTION OF THE DRAWING

Many advantages of the present invention will be apparent to those of ordinary skill in the art when this specification is read in conjunction with the attached drawings. The invention will now be described with reference to the accompanying drawings wherein like reference numerals are applied to like elements and wherein:

FIG. 11A' is a top plan view of a container grasping belt guide plate in accordance with one embodiment of the present invention;

DETAILED DESCRIPTION OF THE PREFERRED EMBODIMENTS

Figure 1:
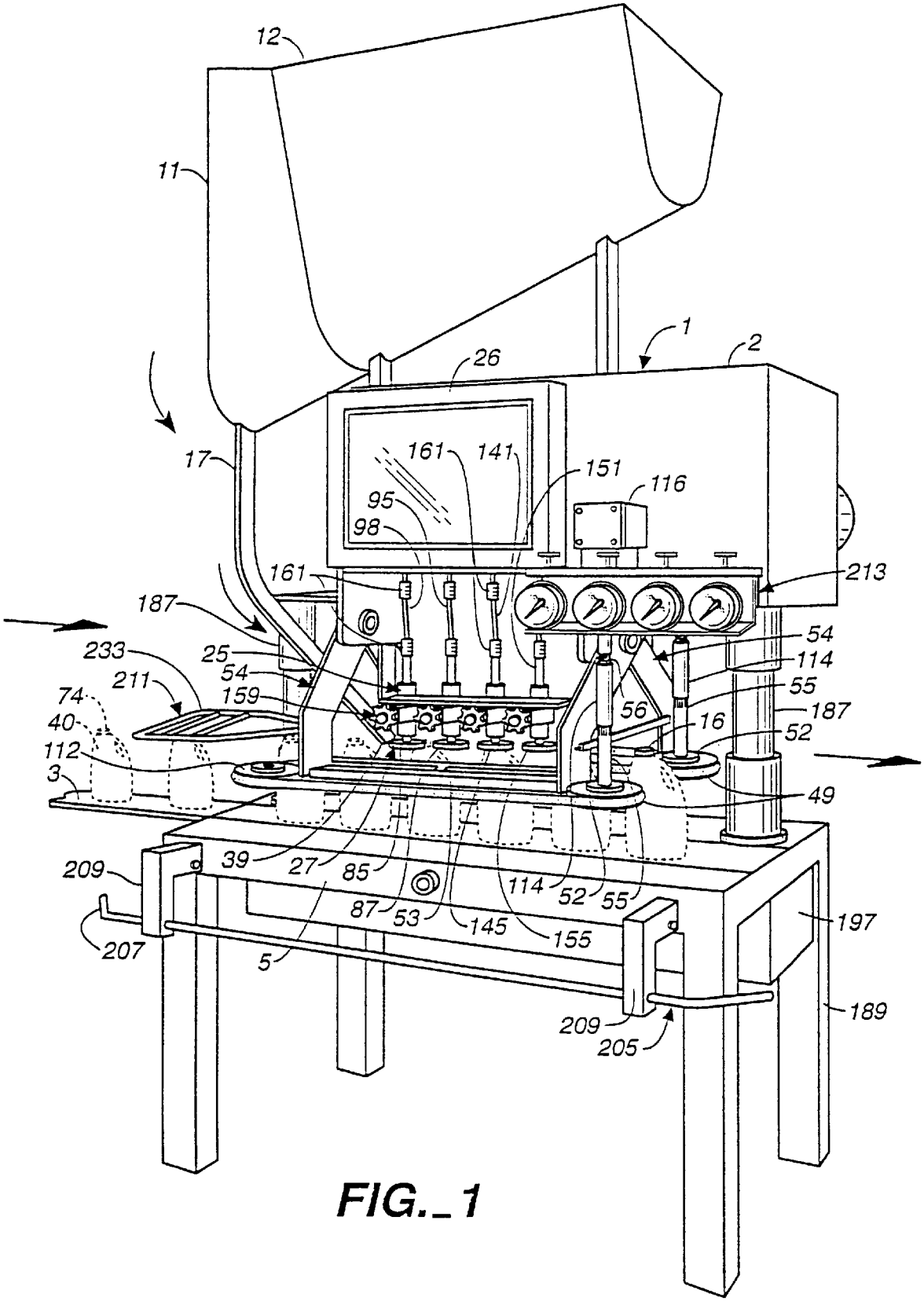
FIG. 1 is a perspective view of one embodiment of a straight line capping machine in accordance with the present invention with a cap feed mechanism and hopper attached.

In FIG. 1, capping machine 1 is generally part of a large assembly operation for filling, labeling, sealing and packaging containers with any of a variety of food products or cleaning products such as bleach, detergent, household cleaners, etc. The filled containers 40 are carried along conveyor 3 that connects each of the machines in a series along the assembly line. Each machine in the series may or may not have its own conveyor belt. If each machine does not have its own conveyor belt, as with capping machine 1 in accordance with one embodiment of the present invention, then the conveyor is operated at a predetermined speed (e.g., 170 feet/minute) as set by the rest of the assembly line.

Cap feed mechanism 11 generally is not part of the capping apparatus, but is attached to the apparatus for operation. A large variety of cap feed mechanisms can be used and the one in FIG. 1 is shown just for illustration purposes. Cap feed mechanism 11 extends between a hopper 12 and a cap-receiving end of the remainder of the capping apparatus, cap feed mechanism 11 includes an inclined cap chute 17. Chute 17 provides means to prevent caps 16 from lifting up and falling out of the chute. The lower end of the chute has a gate 39 from which caps 16 are pulled out one at a time as filled containers 40 traveling along conveyor belt 3, move therebeneath. The elevation of the gate 39 is adjustable so that the caps are at a proper presentation level for the containers to strip them from the gate, as shown in FIG. 1.

Figure 3:
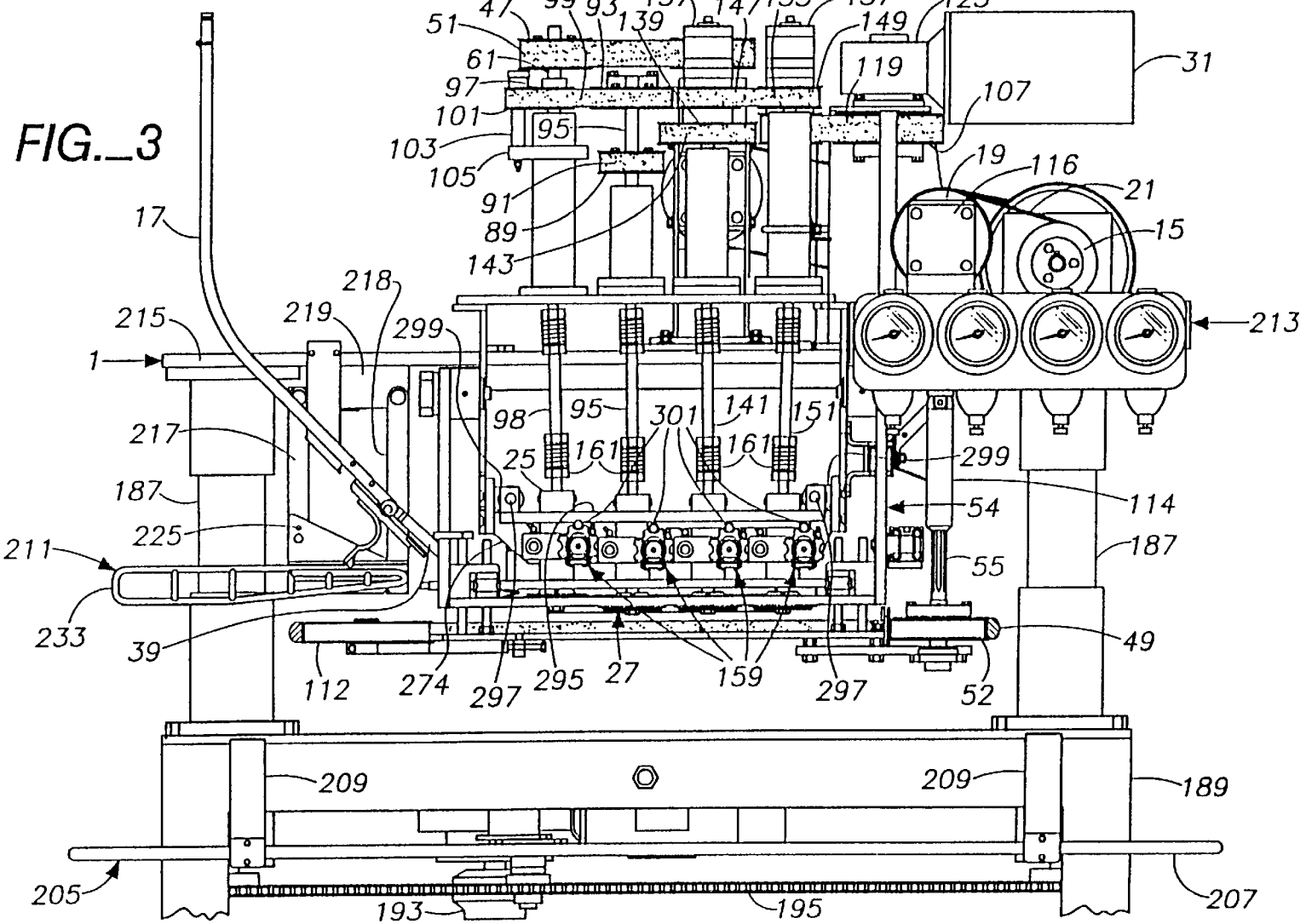
FIG. 3 is a front elevational view of the straight line capping machine of FIG. 2.

As shown in FIGS. 1 and 3, the chute and gate are inclined so that the lowermost cap is also inclined. It is to be noted that all the caps are positioned in the chute so that their threaded opening is on their bottom side when arriving at the gate. Thus due to the inclined position of the lowermost cap, when a container 40 moves horizontally therebeneath, the leading edge of the cap being lower than the upper edge of the container results in the container pulling the cap out of the gate so that the container now advances ahead with the cap sitting thereupon. The next cap now moves into position against the gate for a next cap dispensing cycle.

Container Grasping Mechanism

Just prior to cap 16 being placed upon container 40, the container is grasped between two endless container grasping (or gripper) belts 49 (FIGS. 1, 11A and 18) and the cap arrives below a cap stabilizer that prevents the cap from accidentally falling off of the container. Grasping belts 49 firmly hold against opposite sides of the container and prevent it from rotating as the belts move each container 40 through the capping machine. Accordingly, as containers 40 advance at a specific speed along the conveyor belt 3, grasping belts 49 must likewise move at the same speed. The production line speed of conveyor belt 3 is the starting point for the operation of the capping machine of the present invention. The grasping belt speed is set to match the predetermined line speed. Each of the endless grasping belts moves around a pair of drive rollers (or sprockets) 52, which are powered by main motor 110 (FIG. 2), a pair of guide plates 53 (FIG. 11A), and guide rollers (or idler pulleys) 112. Grasping belts 49 have gear tooth shaped transverse ridges on their inside surface (the side opposite the side that contacts the containers) to engage transverse grooves in the drive rollers (i.e., sprockets).

Each set of container grasping belt 49, its corresponding drive roller 52, guide roller 112 and guide plate 53 can be made as a unit or container grasping assembly 54 that can be moved toward or away from container 40 so as to accommodate different sizes of containers. Assemblies 54 can also be spread apart for set-up and clean-up of the machine, as will be described in more detail below. Likewise, the assemblies can be raised and lowered to adjust the grasping belts with respect to the height of the container. A safety housing is typically mounted around the container grasping assembly to prevent an operator from being injured during the operation of the capping machine. The safety housing for the present invention has been removed to show the working parts of the machine.

In addition to the safety housing around the container grasping assembly, emergency stop bar assembly 205 is provided along the operator side of base 189. Emergency stop bar assembly 205 is comprised of stop bar 207, which extends beyond the full length of the capping machine, attached to the end of pivot arms 209. Emergency stop bar assembly 205 is wired into the main control power circuit which controls the main drive motor 110, motor 31, motor 193 and the air supply so that the container grasping belts can be stopped along with all other moving parts if an emergency arises by simply pushing on stop bar 207 with a knee, thigh, hip, hand, etc. To thereafter restart any or all of the capping machine, it is necessary for the operator to reset the control power circuit.

Figure 4:
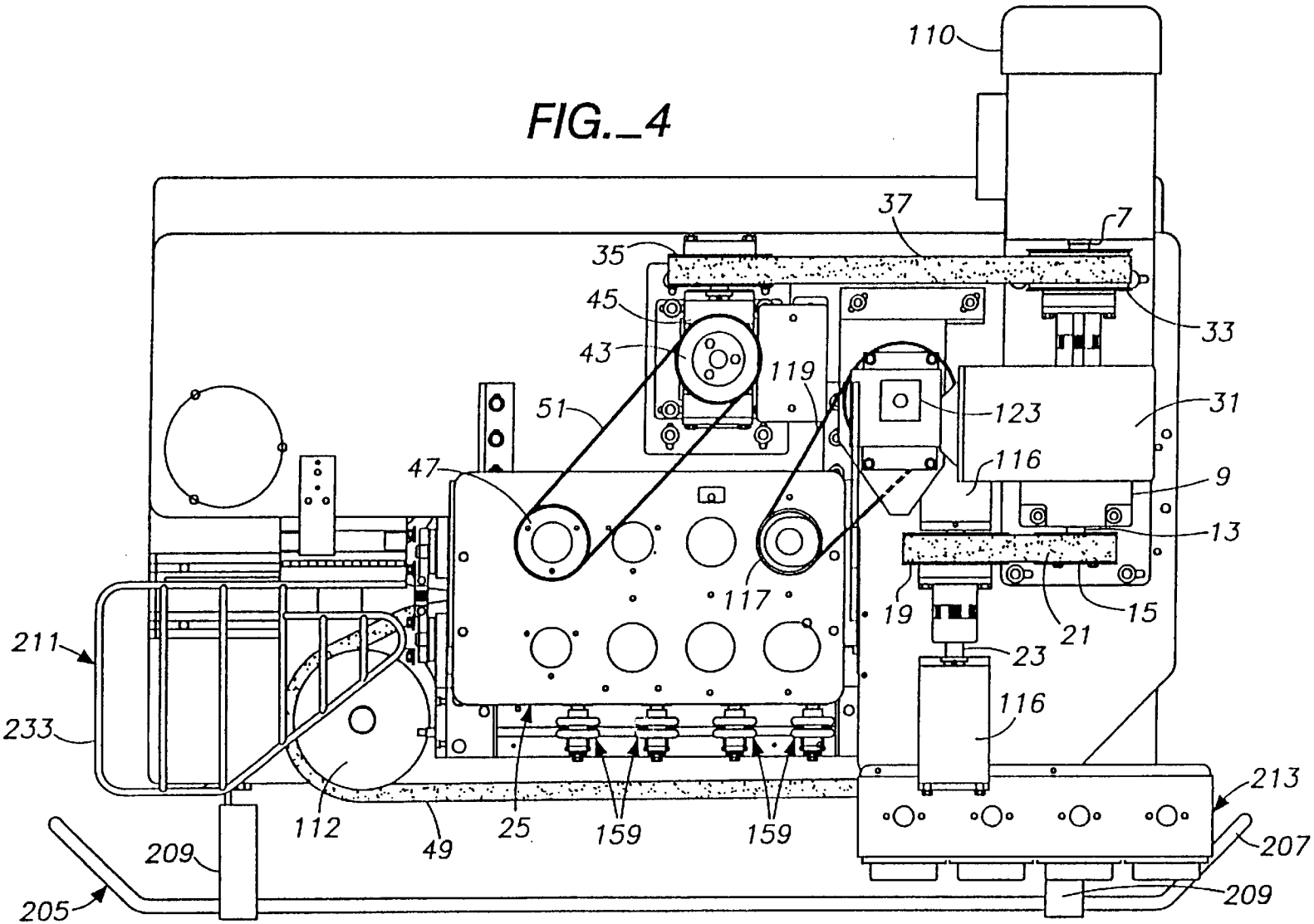
FIG. 4 is a top plan view of the capping machine of FIG. 2.
Figure 15:
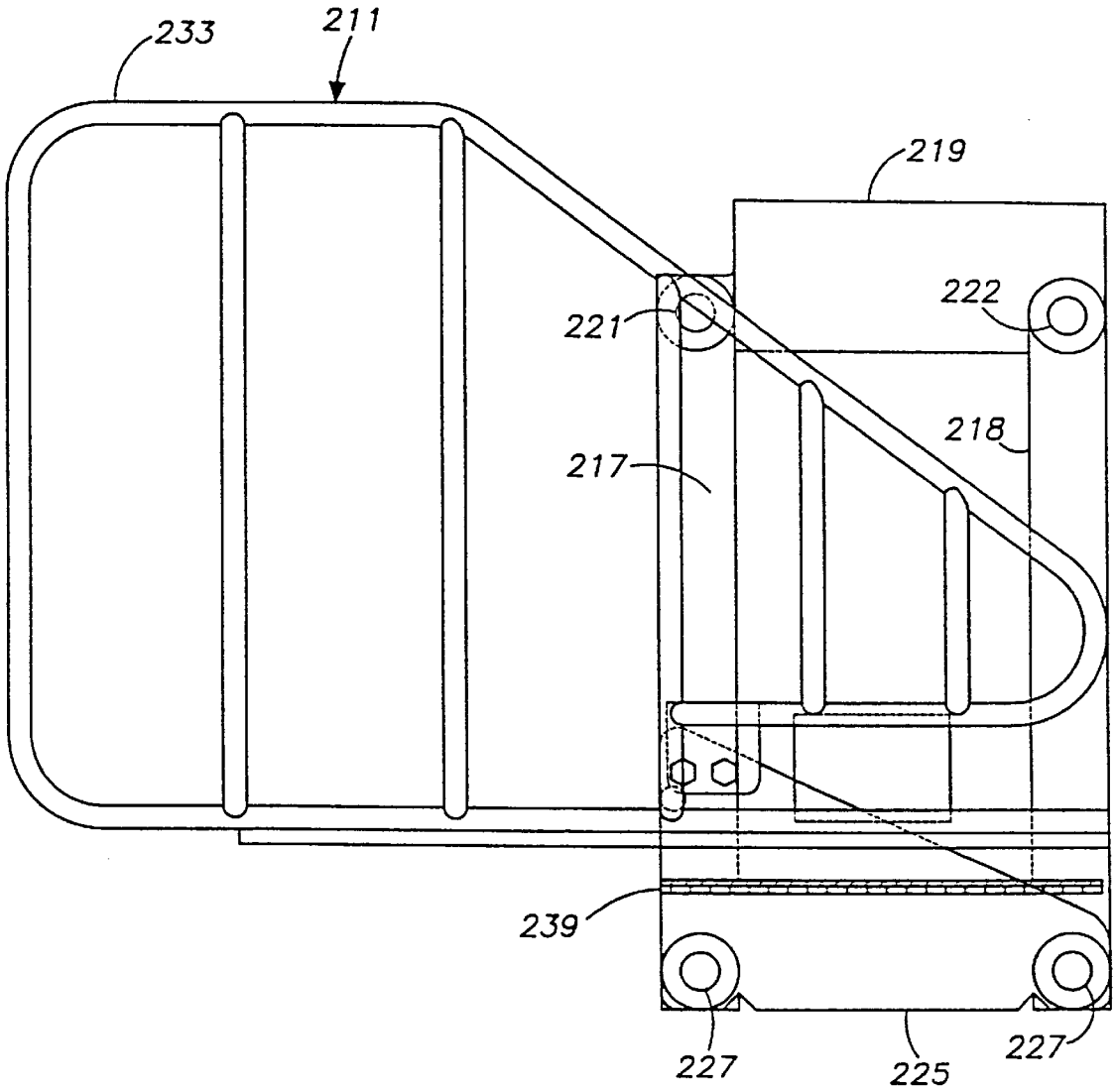
FIG. 15 is a front elevational view of a safety mechanism in accordance with one embodiment of the present invention.
Figure 15A:
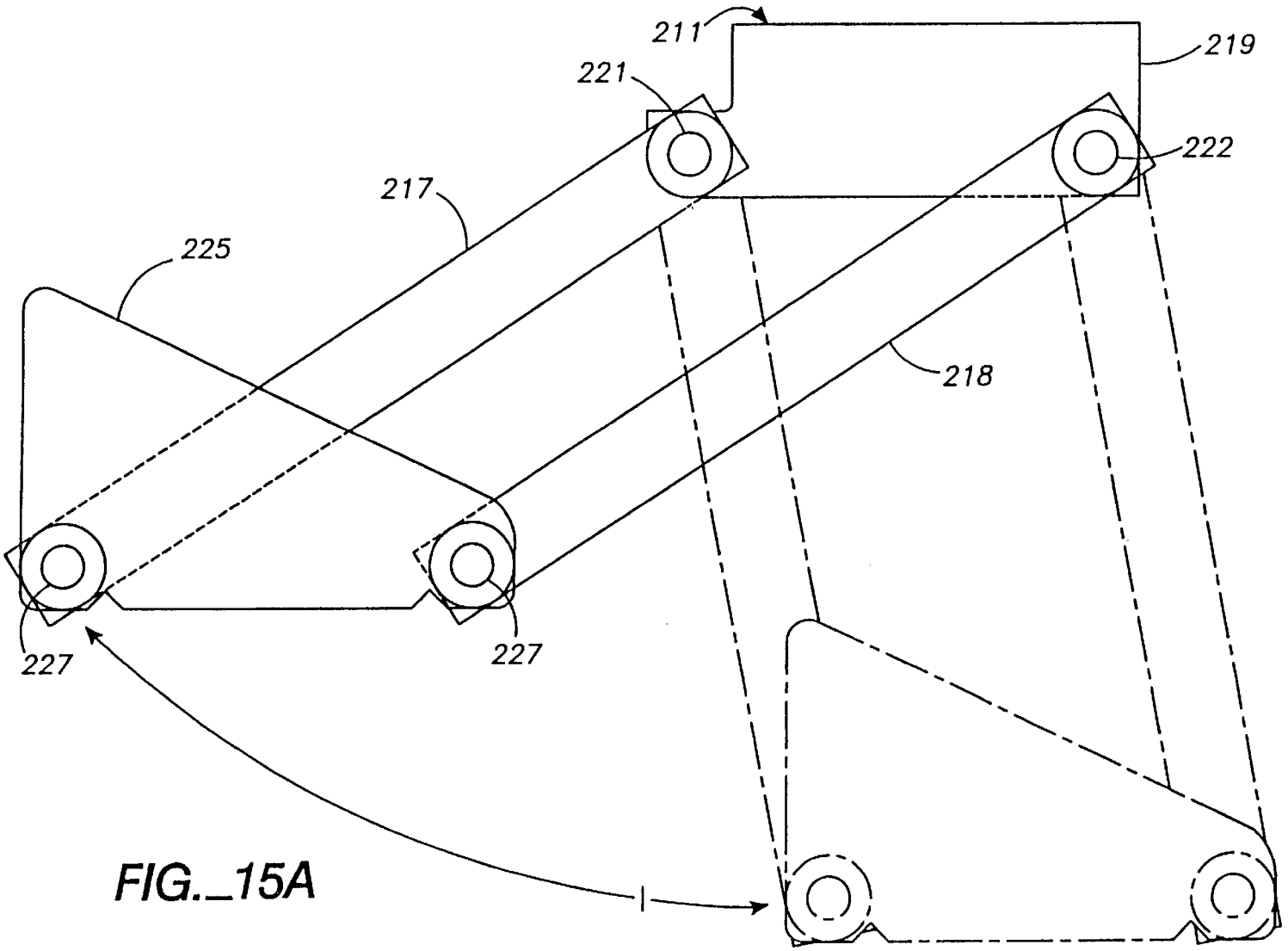
FIG. 15A is a front elevational view of the movement of the safety mechanism of FIG. 15 with the hinged weldment removed for clarity.
Figure 16:
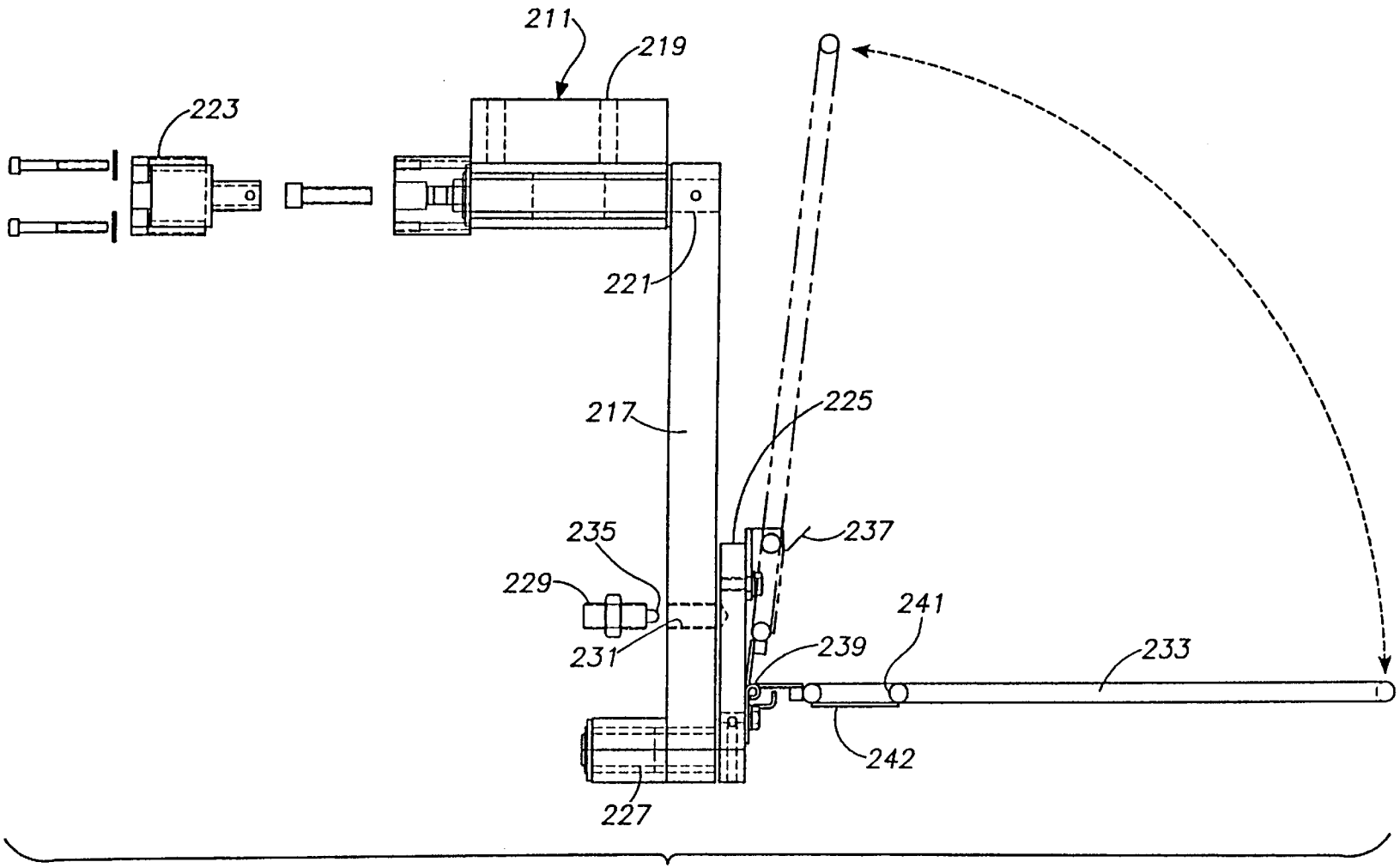
FIG. 16 is a left side elevational partially exploded view of the safety mechanism.
Figure 17:
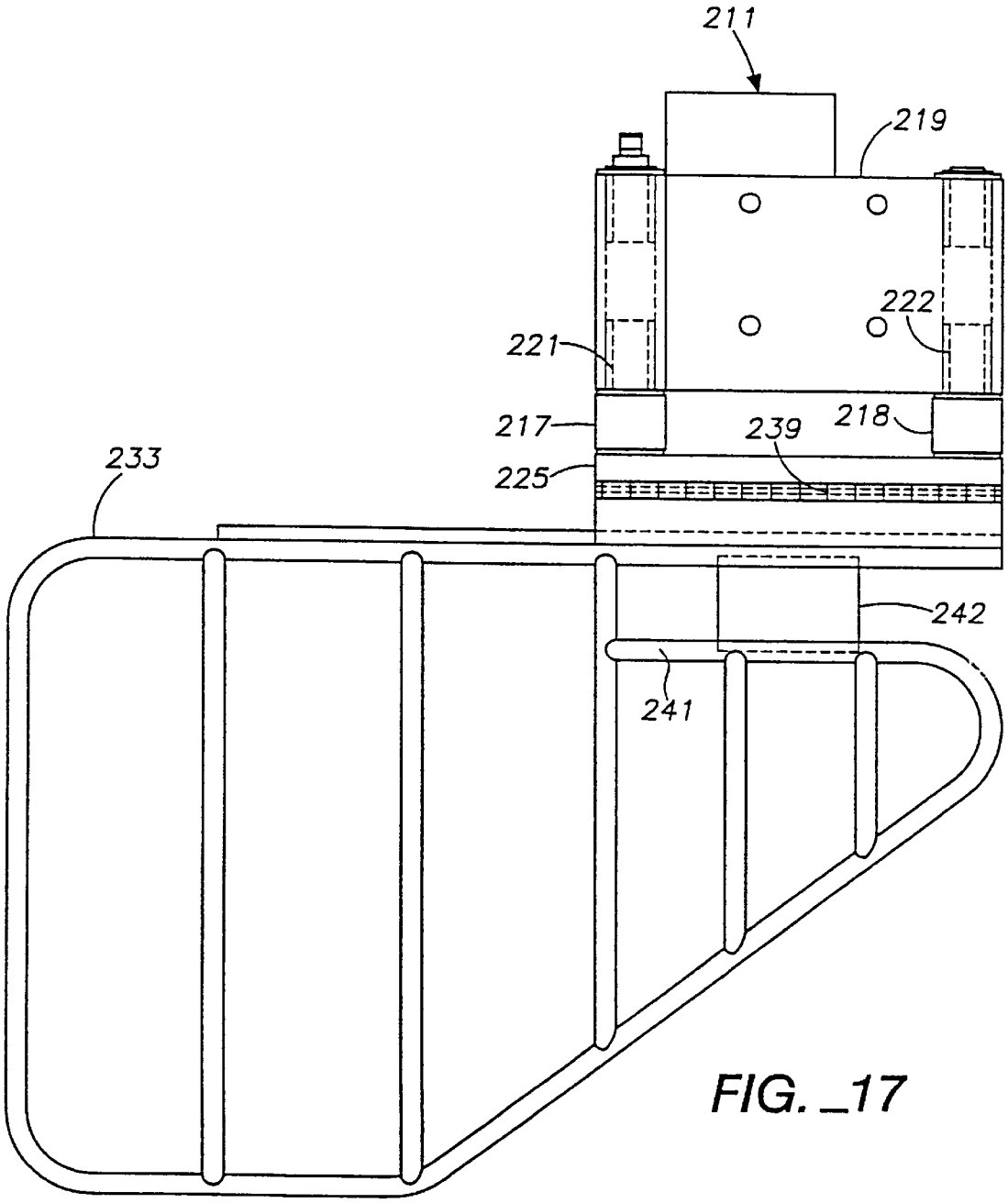
FIG. 17 is a top plan view of the safety mechanism.

Another safety mechanism wired into the main control power circuit that can stop the capping machine (principally, the container grasping belts) from operating in an emergency situation is inlet guard assembly 211 (FIGS. 15–17). Inlet guard assembly 211 is mounted to support plate 215 (FIG. 3) by mounting member 219 in front of the opening into the container grasping belts. Pivot arms 217 and 218 are mounted (at their respective proximal ends) on shafts 221 and 222. Shafts 221 and 222 extend into mounting member 219 and are free to rotate through a large arc in the clockwise direction but only through a very short arc in the counter-clockwise direction. Rotary safety switch 223 is attached to shaft 221 and wired into the main control power circuit such that if the inlet guard assembly 211 is displaced counter-clockwise (or clockwise) as shown in FIG. 15A from its operating position (which is with pivot arms 217 and 218 vertically orientated) then the safety switch will stop the capping machine (principally, the container grasping belts). This typically occurs when an operator or his clothing or jewelry is grasped by the container grasping belts and pulled into the capping machine. In this situation, the operator would contact weldment 233, which extends away from the inlet of the container grasping belts, and displace the pivot arms counter-clockwise a sufficient amount to trigger rotary safety switch 223 (FIGS. 1, 3 and 4). Likewise, displacement clockwise of rotary safety switch 223 when the machine is running will stop the container grasping belts. This prevents an operator from attempting to move the safety mechanism out of the way when the machine is operating.

Pivot mount 225 extends between the distal ends of pivot arms 217 and 218. Pivot arms 217 and 218 are pivotally mounted on shafts 227 which extend through pivot mount 225 and pivot arms 217 and 218. Spring plunger 229 is mounted in cavity 231 of pivot arm 217 so as to provide a bias against pivot arm 217 while the pivot arm is in its vertical orientation. However, plunger 235 is pressed back into spring plunger 229 when the pivot arms are displaced clockwise or counter-clockwise.

Weldment 233 is hinged to pivot mount 225 by hinge 239 so that it can be flipped up and attached behind spring clip 237. Portion 241 of weldment 233 urges spring clip 237 up and then locks in behind the spring clip to hold the weldment in a vertical orientation. This is particularly useful while the capping machine is turned off during initial set-up or clean-up of the capping machine. It is also useful to rotate the inlet guard assembly in the clockwise direction and retain it in that position during set-up or clean-up of the machine. Portion 242 of the weldment 233 extends below a portion of the cap gate 39 in such a fashion that pivot arms 217 and 218 cannot reach their vertical orientation unless weldment 233 has first been lowered. By this means, the capping machine cannot be operated unless weldment 233 is in a position which protects the operator from being drawn into the container grasping belts.

Figure 2:
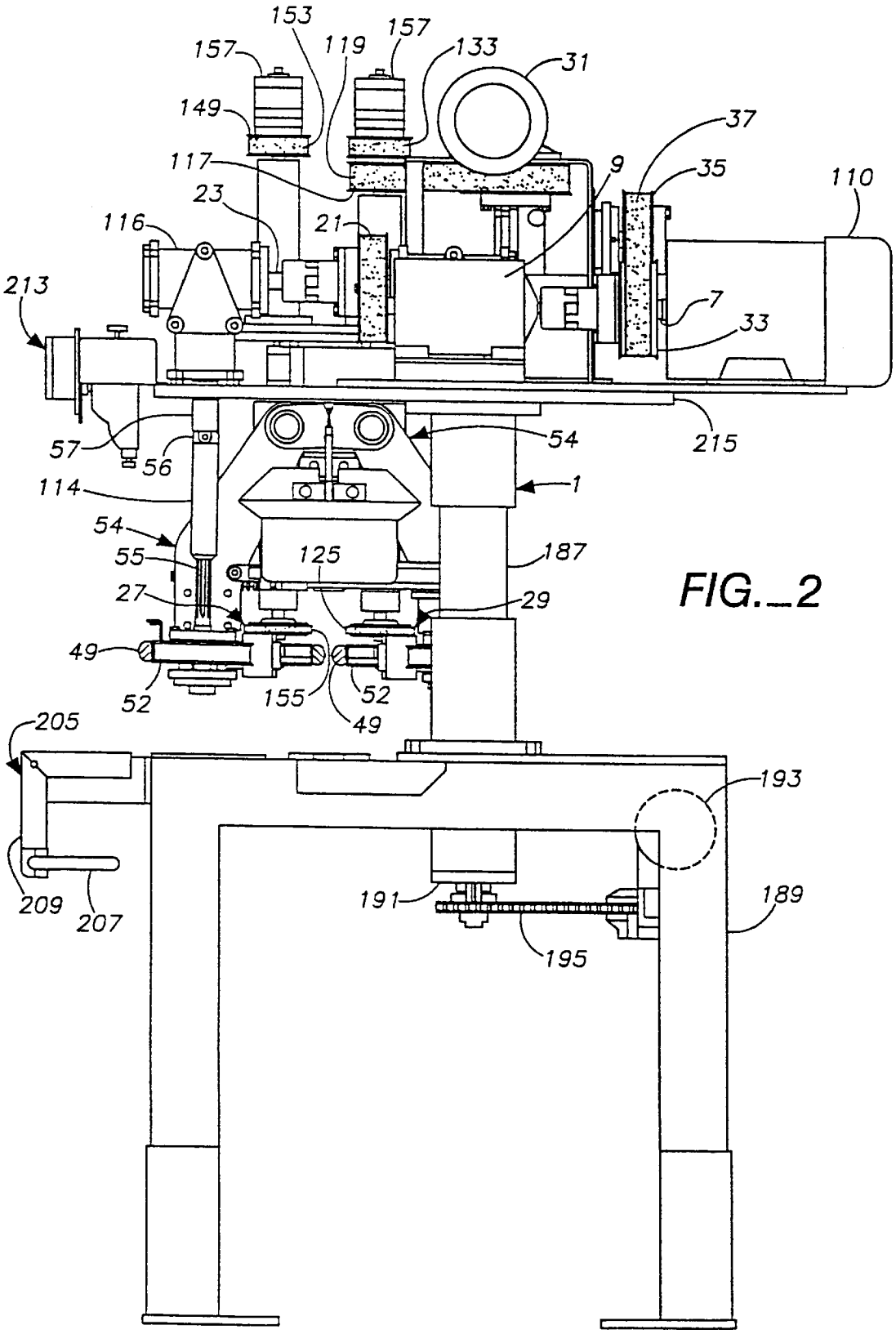
FIG. 2 is a right side elevational view of the straight line capping machine of FIG. 1 with the hopper and some of the gear guards removed.

In order to rotate the container grasping belts, each drive roller 52 is affixed to a drive shaft 55 which is grooved (i.e., splined) and slidably received in sleeve 114 of universal joint 56. The purpose of sleeve 114 is to allow sliding the drive shaft 55 within the sleeve so that belts 49 can be brought either closer together or further apart in order to accommodate containers of different sizes therebetween. Drive shaft 55 preferably has full spline engagement throughout the full adjustment range to prevent premature spline failure due to wear. Likewise, the container grasping assembly can be raised or lowered to accommodate containers of different heights. In fact, the container grasping assemblies and the cap tightening and torquing mechanism are raised or lowered simultaneously on telescoping support columns 187 which support the majority of the capping machine above base 189 (FIGS. 1–3). Elevator drive mechanism 191 connected to elevator motor 193 by drive chains 195 raise and lower support columns 187. Generally, the elevator drive mechanism and drive chains are housed in safety housing 197 (FIG. 1). Preferably, a brake (not shown) is added to the elevator motor to prevent over travel of the components. One example of an acceptable elevator motor is a 0.75 horsepower, 480/230 VAC, 3 phase, 60 hz TEFC with integral brake. A pointer and scale (not shown) or a linear variable transducer coupled to a digital readout display can be added to the capping machine to make it easier to set the gripper belt height.

Figure 5:
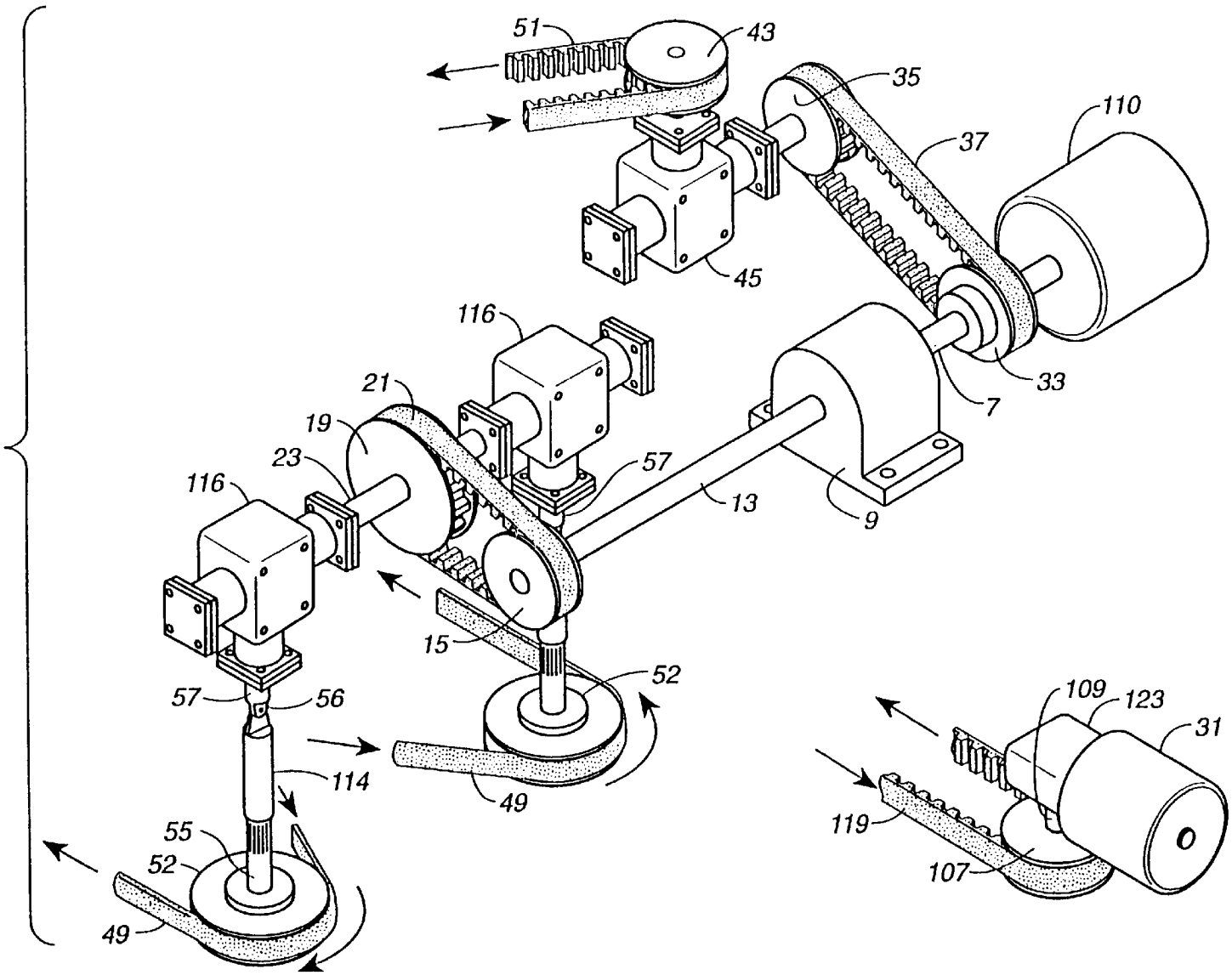
FIG. 5 is a schematic isometric view of part of the drive pulleys and belts in accordance with one embodiment of the present invention.

Universal joint 56 is connected to power shaft 57 (FIG. 2 and 5). Power shaft 57 is the downward facing output shaft of angle gear 116 which is driven by main motor 110. As discussed previously, as containers 40 advance at a specific speed along the conveyor belt 3, grasping belts 49 must likewise move at the same speed. It should be noted that the container speed through the machine is controlled by grasping belts 49. A belt and conveyor speed (and thus a container speed) of 170 feet per minute will be used for describing the present invention for illustration purposes. However, it should be understood that the capping machine of the present invention can operate with a belt and conveyor speed in the range of 50 to 250 feet per minute and preferably from 80 to 200 feet per minute. In other embodiments with different motors and components a range of 1 foot per minute to 500 feet per minute and beyond can be achieved.

The output of main motor 110 (which is 902.845 revolutions per minute for our conveyor speed of 170 feet per minute) is transferred through shaft 7 to speed reducer 9 (FIGS. 2 and 5). In one embodiment, speed reducer 9 is an in-line helical 6.196 to 1 ratio reducer resulting in an output of 145.714 revolutions per minute. The output of speed reducer 9 is transferred through shaft 13 to pulley 15 where it is transferred to pulley 19 through endless belt 21. All of the endless belts of the present invention, except for the conveyor belt, are preferably gear belts (i.e., "timing belts") to help ensure the retention of the speed ratios. Likewise, the pulleys are grooved (i.e., sprockets) to accommodate the "teeth" on the gear belts. Pulley 19 has a larger diameter than pulley 15 so as to establish a 0.78 to 1 ratio. Pulley 19 is connected to each 1:1 angle gear 116 through shaft 23 to ensure that each grasping belt 49 moves at the same speed. The 0.78 to 1 ratio results in a speed of 113.333 revolutions per minute for each drive roller 52 which results in a container speed through the capping machine of 170 feet per minute. Shaft 7, pulley 33, speed reducer 9, shaft 13, pulley 15, endless belt 21 and pulley 19 are housed within safety housing 2 shown in FIG. 1 during normal operation.

Figure 11:
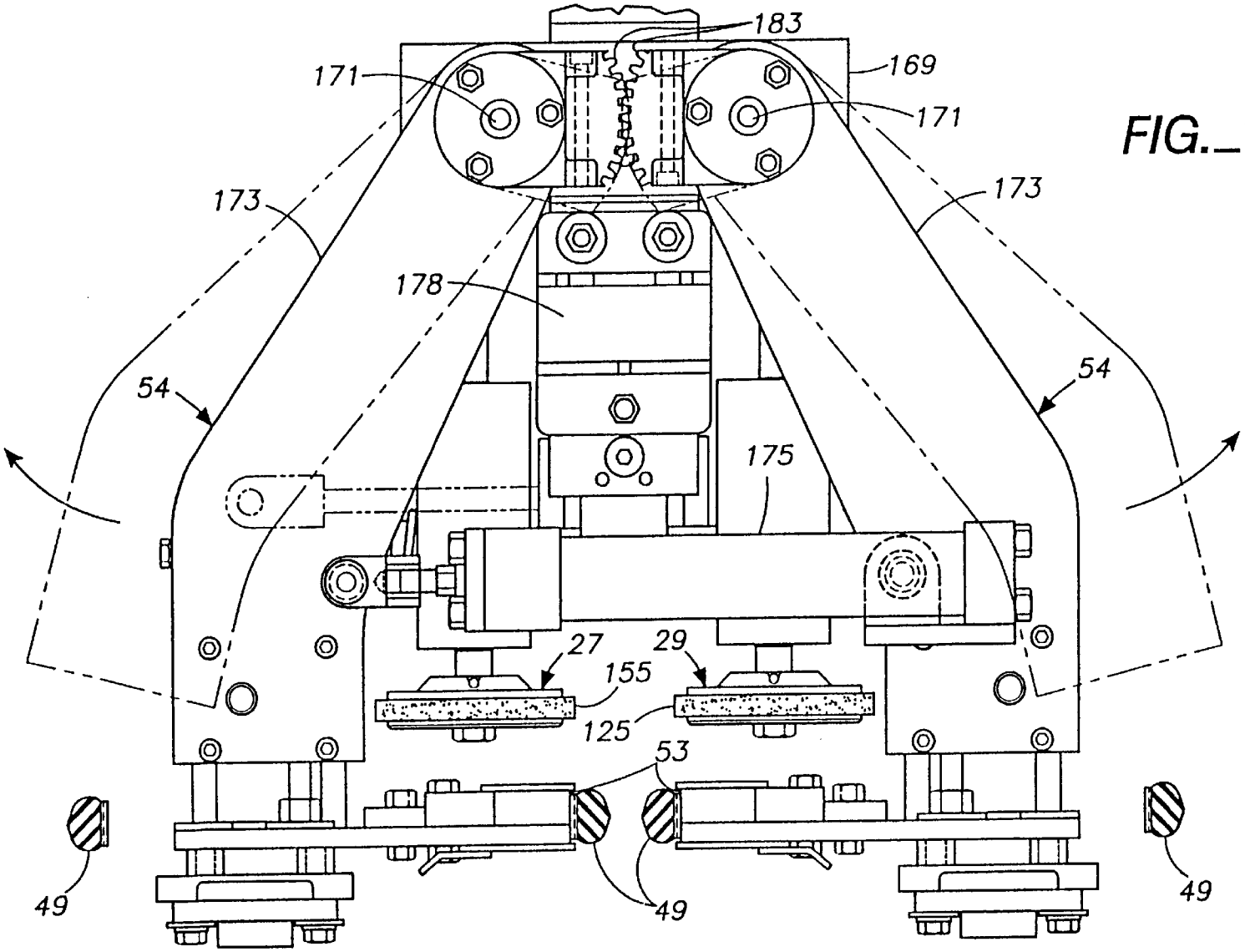
FIG. 11 is a right side elevational view of the cap tightening and torquing mechanism and container grasping mechanism in accordance with one embodiment of the present invention.
Figure 11A:
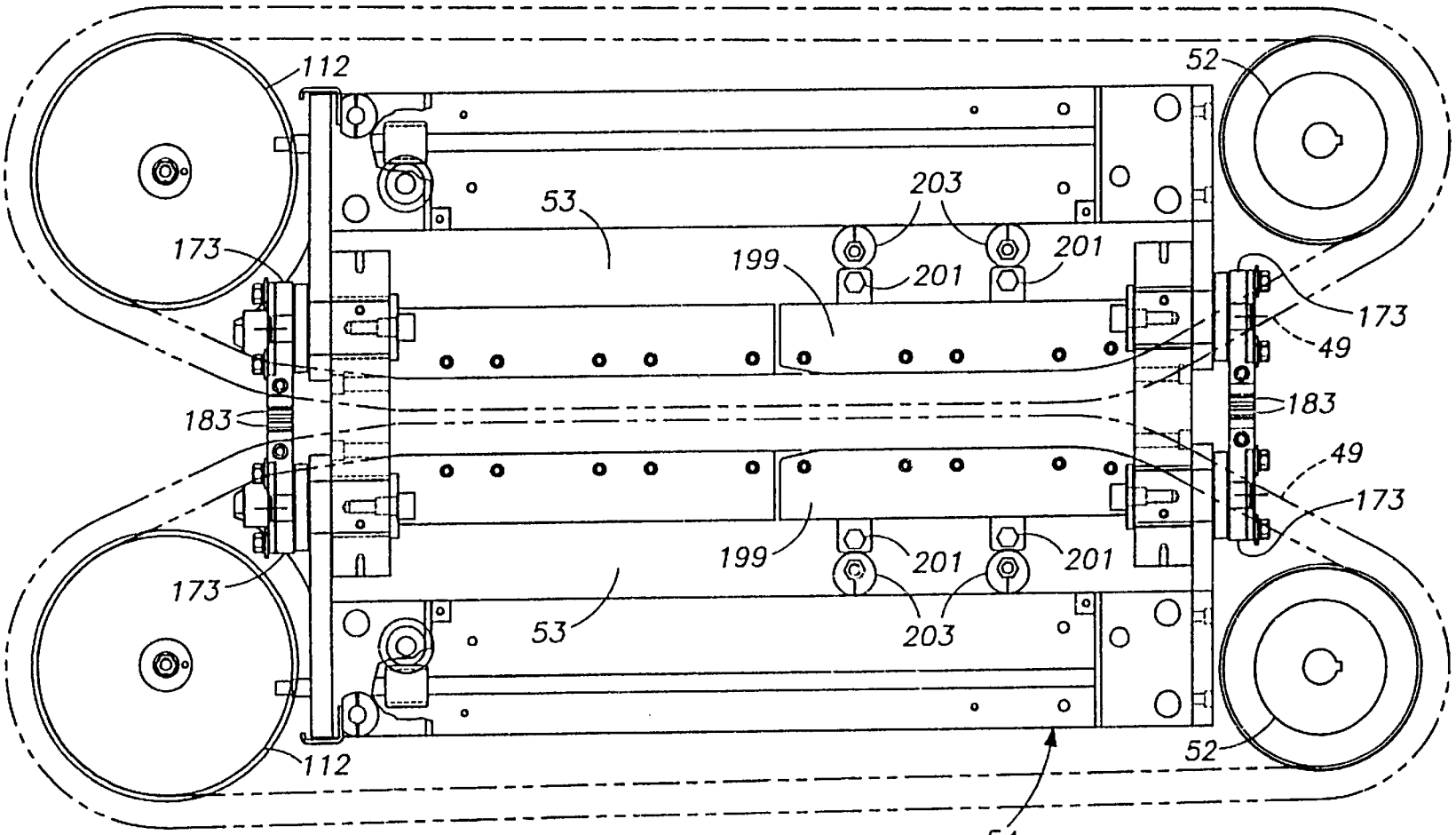
FIG. 11A is a top plan view of a container grasping mechanism with some elements removed for clarity in accordance with one embodiment of the present invention.
Figure 11A:
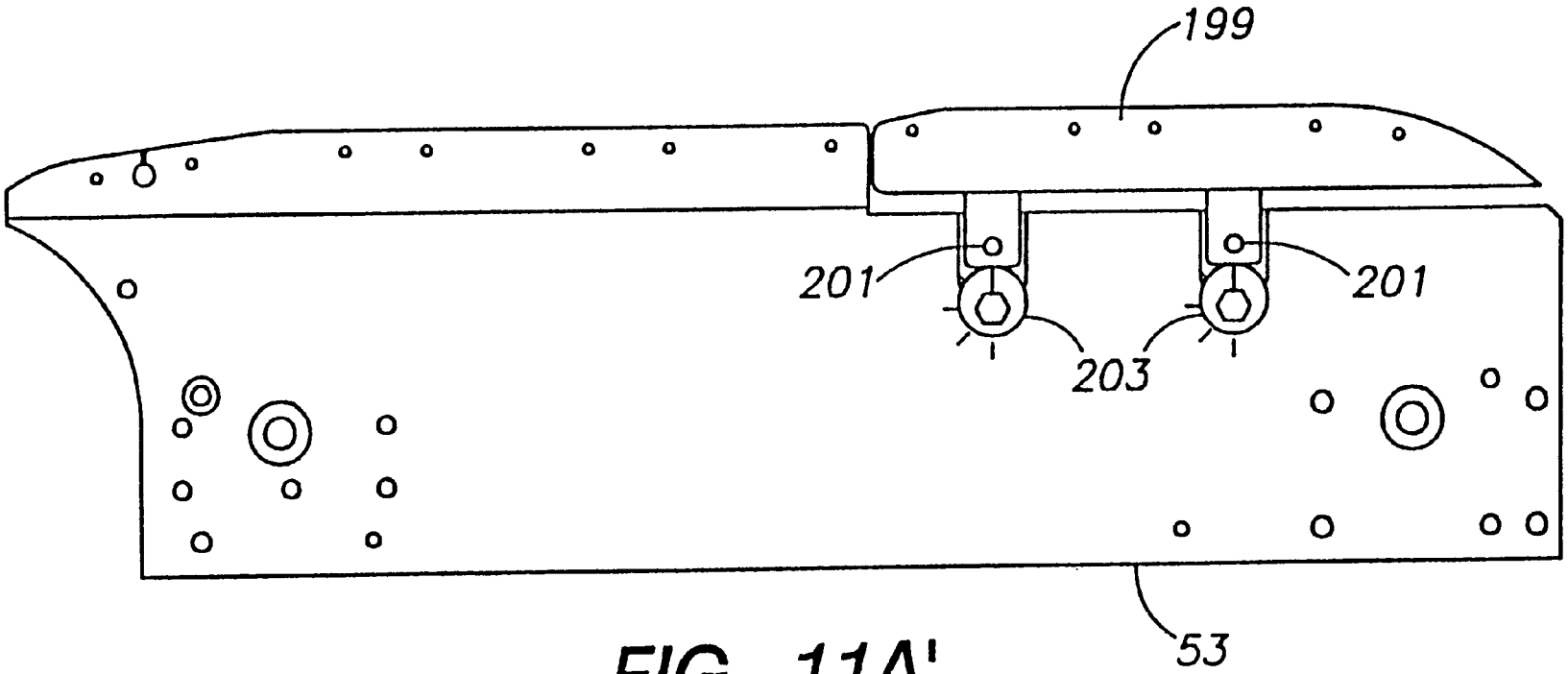
Figure 12:
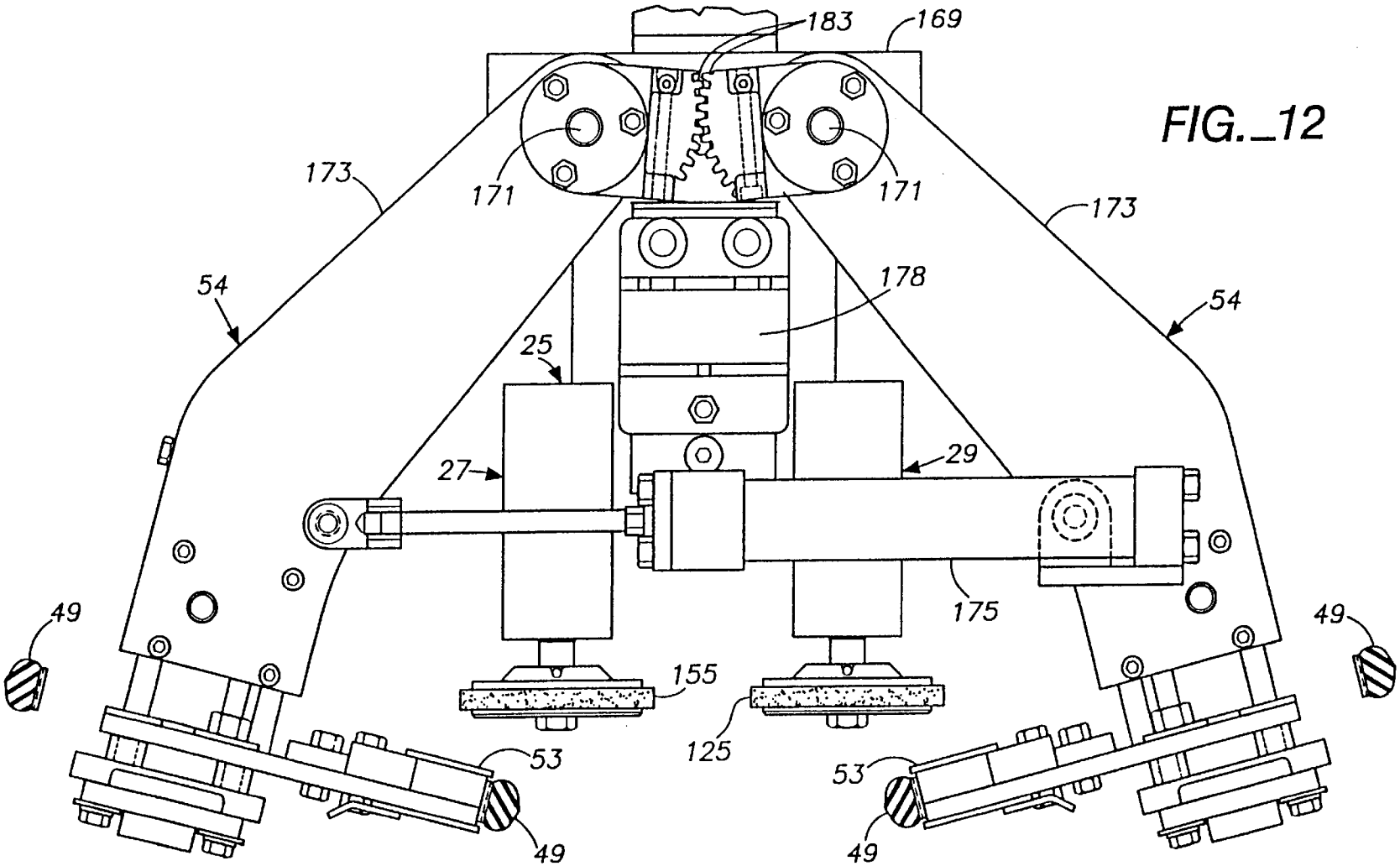
FIG. 12 is a right side elevational view of the cap tightening and torquing mechanism with the container grasping mechanism articulated apart in accordance with one embodiment of the present invention.
Figure 13:
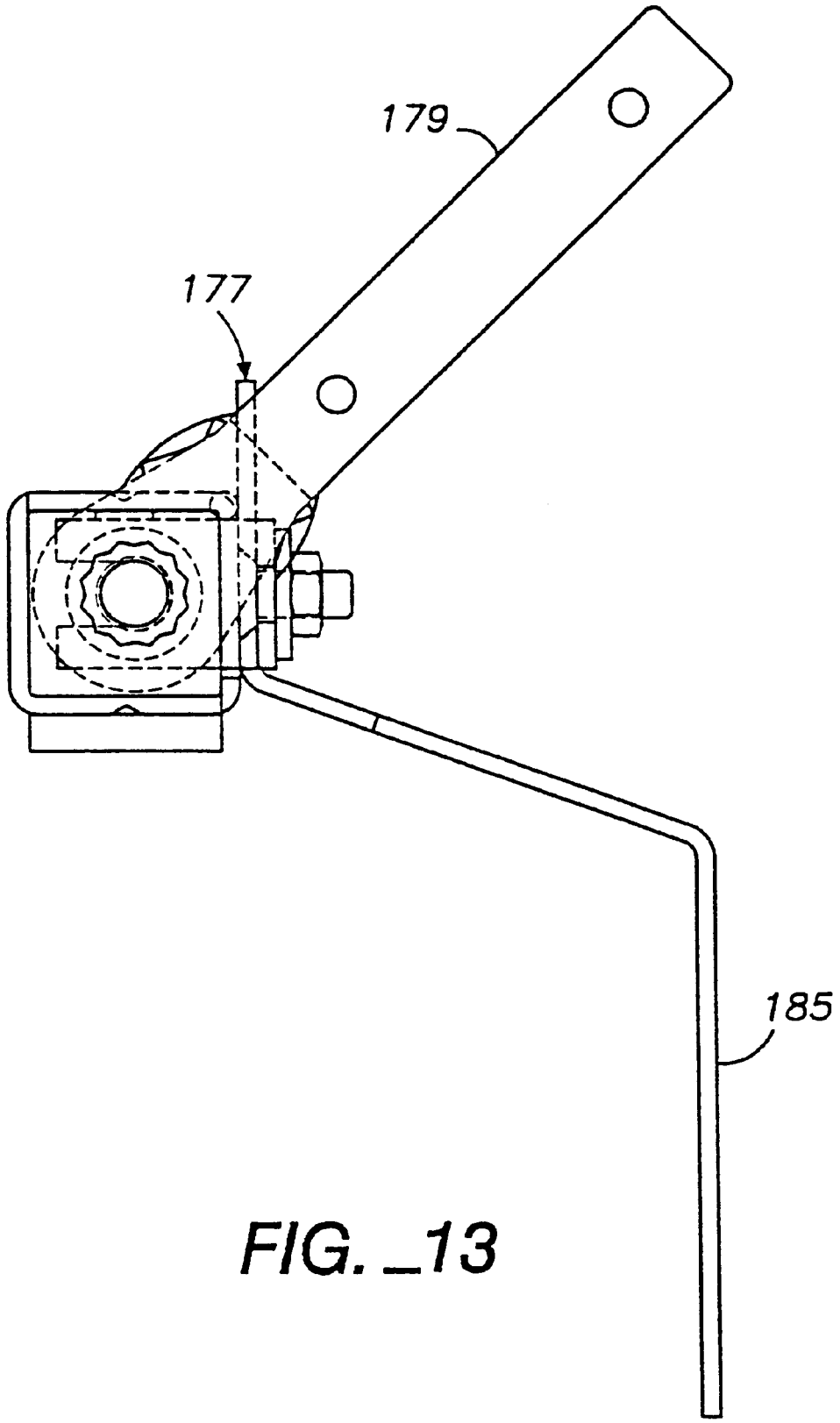
FIG. 13 is a front elevational view of a container grasping adjustment mechanism in accordance with one embodiment of the present invention.
Figure 14:
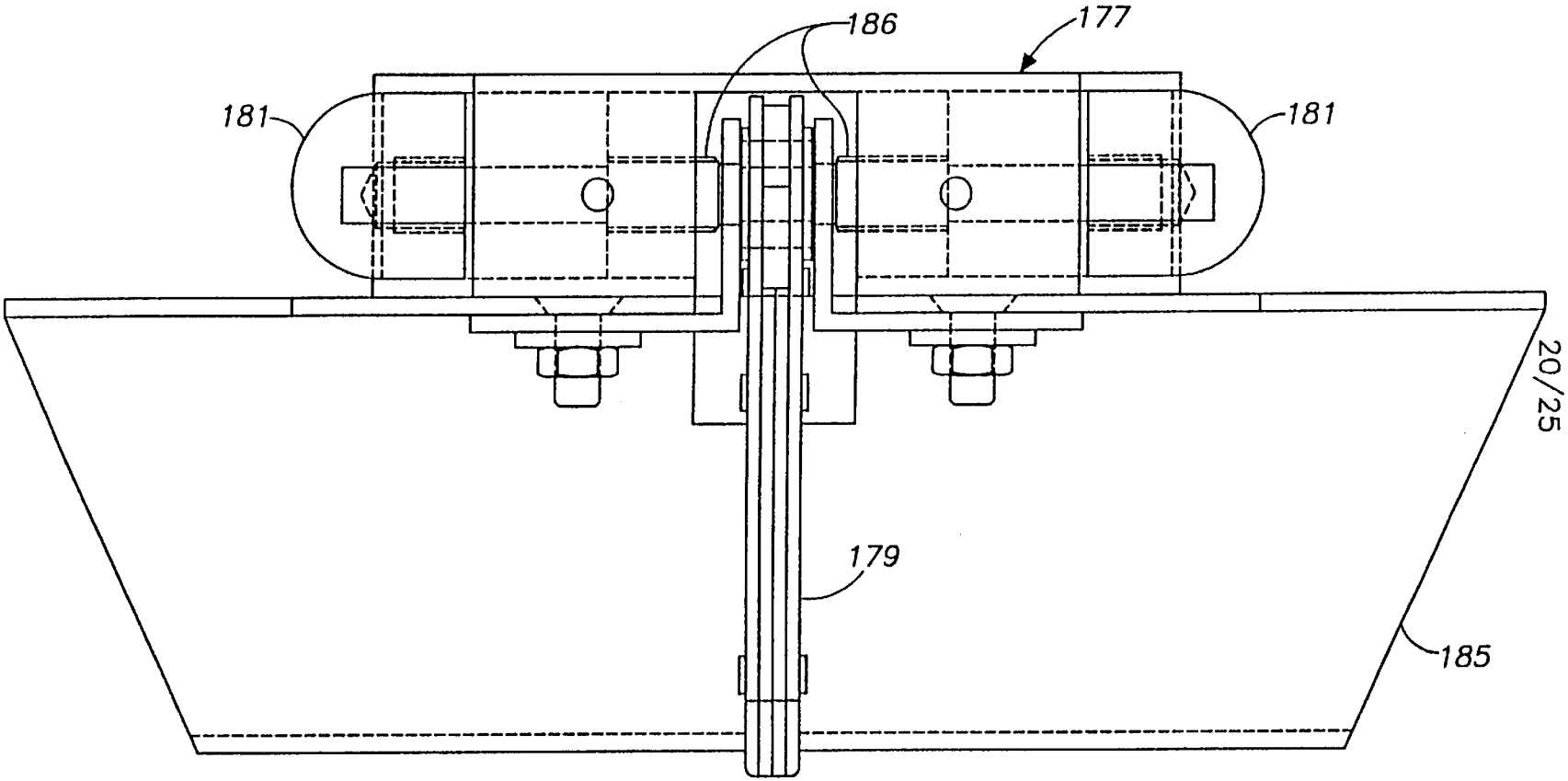
FIG. 14 is a top plan elevational view of the container grasping adjustment mechanism of FIG. 13.

As mentioned above, container grasping assemblies 54 can be spread apart or moved together so as to accommodate different sizes of containers and/or to install new capping discs (FIGS. 11 and 12). Each assembly is mounted to central support 169 about pivot point 171 at the proximal ends of a pair of support arms 173. Drive rollers 52, guide plates 53 and guide rollers 112 are attached to the distal ends of support arms 173. Cylinder 175 is attached between each of the support arms for spreading the two container grasping assemblies apart or pressing them together. Cylinder 175 spreads the container grasping assemblies apart to a width greater than the width of the containers to be run through the capping machine then adjustable cartridge 177 (FIGS. 13 and 14) is placed between container grasping assemblies 54 at the discharge end of the capping machine on bracket 178. Bracket 178 helps to ensure that adjustable cartridge 177 is centered between support arms 173 and remains centered. Teethed cams (i.e., gear segments) 183 engage each other adjacent to pivot points 171 so that when cylinder 175 is articulated, the container grasping assemblies spread apart at an equal rate along an arc with its center at the pivot point.

Adjustable cartridge 177 has a ratchet handle adjustment 179 for moving width adjustable stops 181 in or out with adjusting screw 186 on either side of the ratchet to set the correct amount of drag for the gripper belts 49 against the containers to be passed through the capping machine. Adjusting screw 186 has right hand threads on one end and left hand threads on the other end. Cylinder 175 is typically an air cylinder and operates as an air spring to provide resistance against the adjustable cartridge when it is adjusted with the ratchet. The tightness of the grip on the bottles should be adjusted to such a point that when a container is twisted by hand, there should be a definite, firm drag on the container but it should still be able to turn. Typically, only about 5–6 in-lbs of holding torque between the gripper belts is sufficient for the region near first pair 75 and second pair 76 of discs. Care should be taken to not compress the container neck enough to distort the finish. Any distortion of the finish will keep the discs of the first pair and the second pair from starting the caps correctly or will keep the caps from turning all the way down. Different width adjustable cartridges can be used that are preset to the approximate width of many different sized containers so that switching to a production run of a smaller or larger container can be accomplished more easily and efficiently. Housing 185 can be provided on adjustable cartridge 177 to prevent an operator from inadvertently harming themselves between the gripper belt assemblies and/or the support arm pinch points.

In the region near third pair 77 and fourth pair 78 of discs (FIG. 6), greater holding torque is needed between the gripper belts to hold the container while torquing the cap onto the container as will be described in more detail below. Therefore, an adjustable step 199 (FIG. 1A and 11A') is provided in gripper belt guide plates 53 to bring gripper belt 49 closer together in the region near the third pair and fourth pair of discs. Adjustable step 199 can be used to move gripper belt 49 closer to the containers by loosening fasteners 201 on each of the gripper belt assemblies and rotating cams 203. Then fasteners 201 should be tightened after care has been taken to ensure that the guide surfaces remain parallel and that they provide an equal offset on each guide assembly. Typically, 0.125 to 0.250 inches of offset is sufficient to achieve the greater holding torque. With the adjustment about midway between the second pair and third pair of discs, the gripper belts can be set for a light grip on the container between the first pair and second pair of discs and a firm grip on the container between the third pair and fourth pair of discs where the torque is applied to the cap.

Cap Tightening Mechanism

Figure 6:
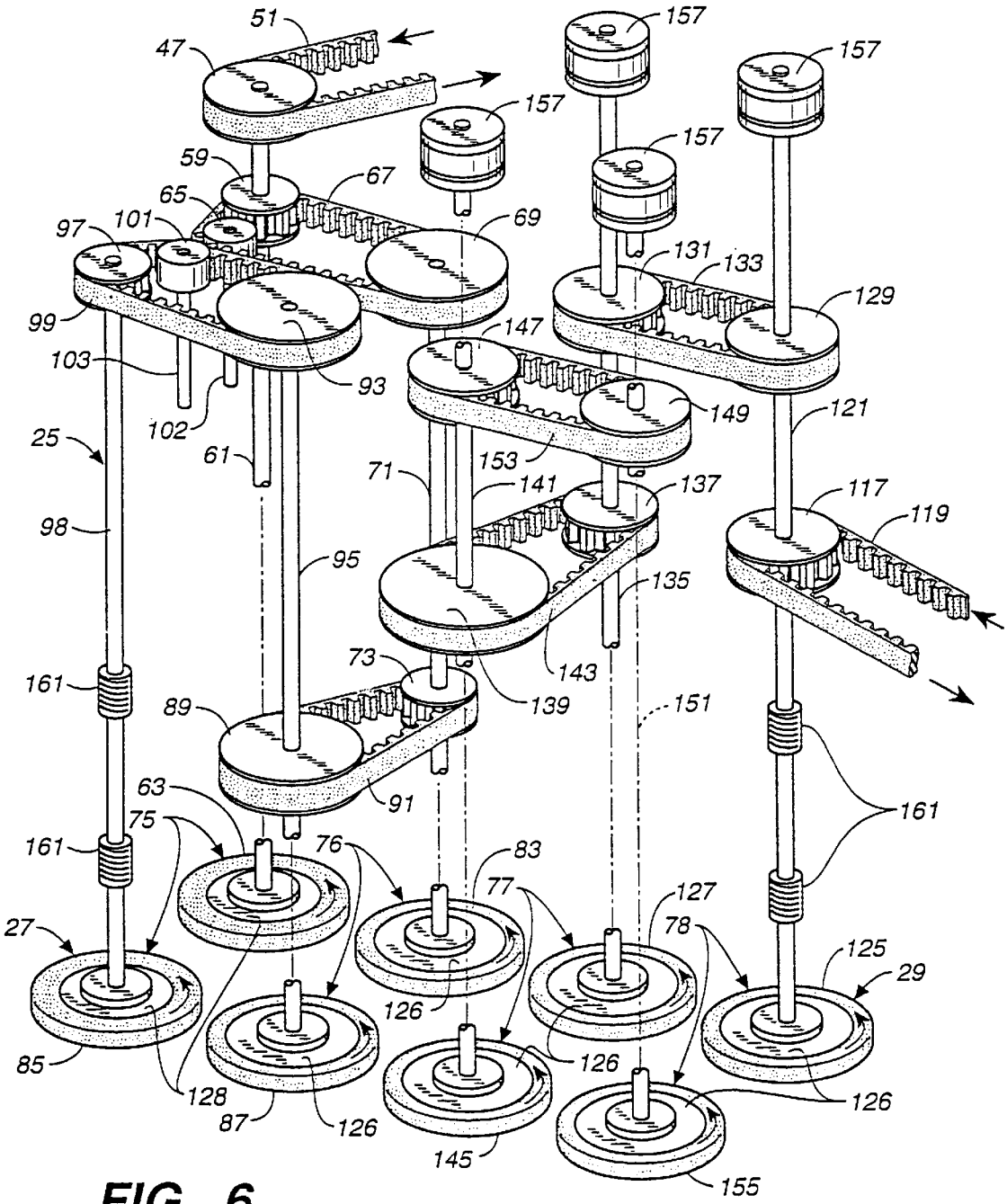
FIG. 6 is a schematic isometric view of part of the capping pulleys, belts and cap tightening and torquing discs in accordance with one embodiment of the present invention.
Figure 18:
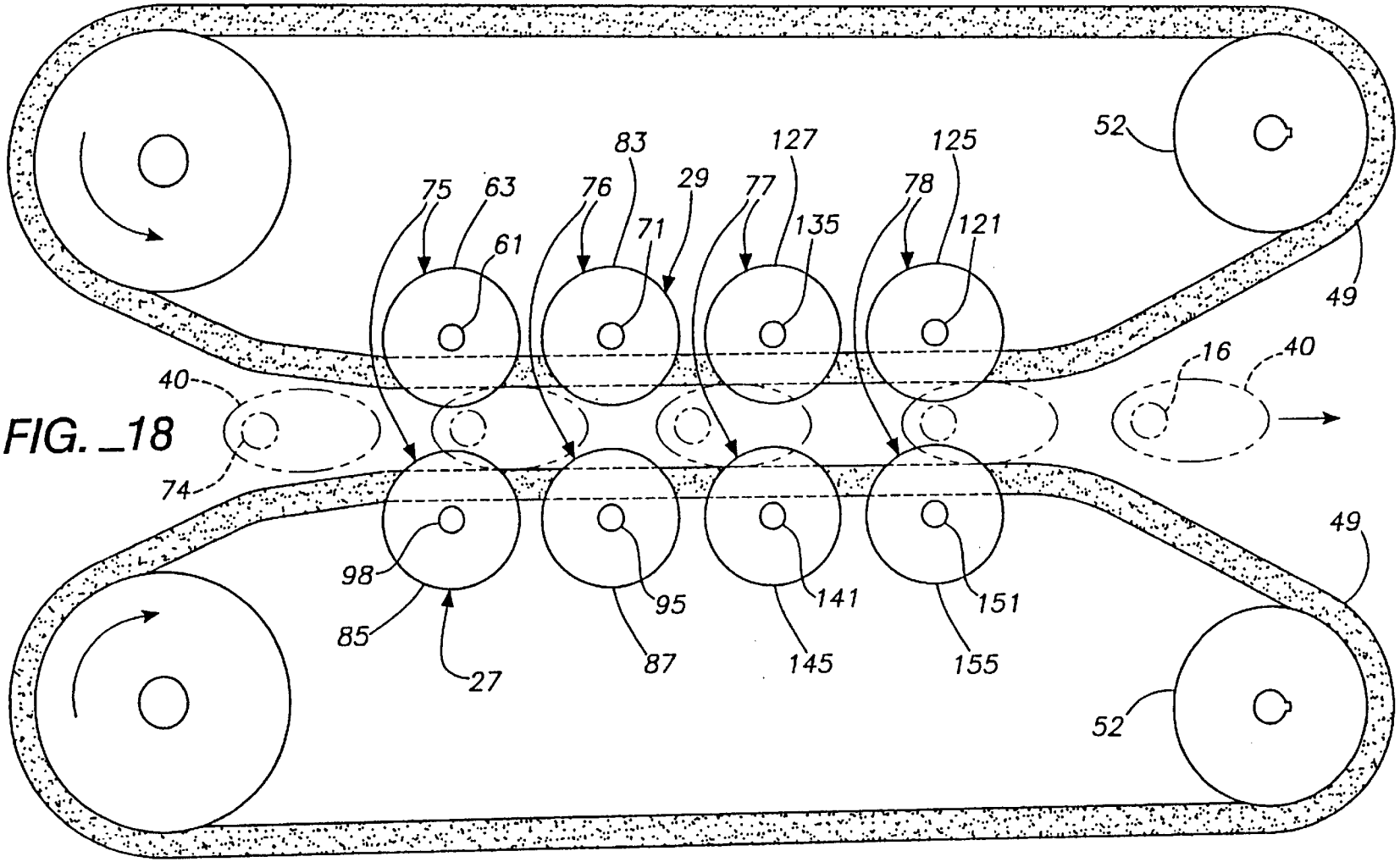
FIG. 18 is a top plan schematic of the container grasping mechanism, cap tightening and torquing mechanism and containers.

In one embodiment, cap tightening and torquing mechanism 25 (FIGS. 1, 3 and 6) includes two rows (i.e., a front row and a back row) of four rotating discs in each row. The majority of the components of the cap tightening and torquing mechanism are housed in safety housing 26 (FIG. 1). As shown in FIGS. 6 and 18, the eight discs are arranged in four pairs. Cap 16 placed on top of container 40 advances first between a first pair of discs 75, then between a second pair of discs 76, then between a third pair of discs 77, and finally between a fourth pair of discs 78. Caps 16 loosely placed upon containers 40 are moved between the two rows so that the rotating discs contact the side of the caps. The counter-clockwise rotating discs cause the caps to rotate clockwise down on each threaded container neck 74. The first two pairs of discs generally rotate the cap completely down on the threaded neck of the bottle and the last two pairs of discs generally torque the cap tight onto the threaded neck to prevent the container from leaking or inadvertently opening. The torquing operation of the last two pairs of discs will be discussed in more detail below.

Figure 9:
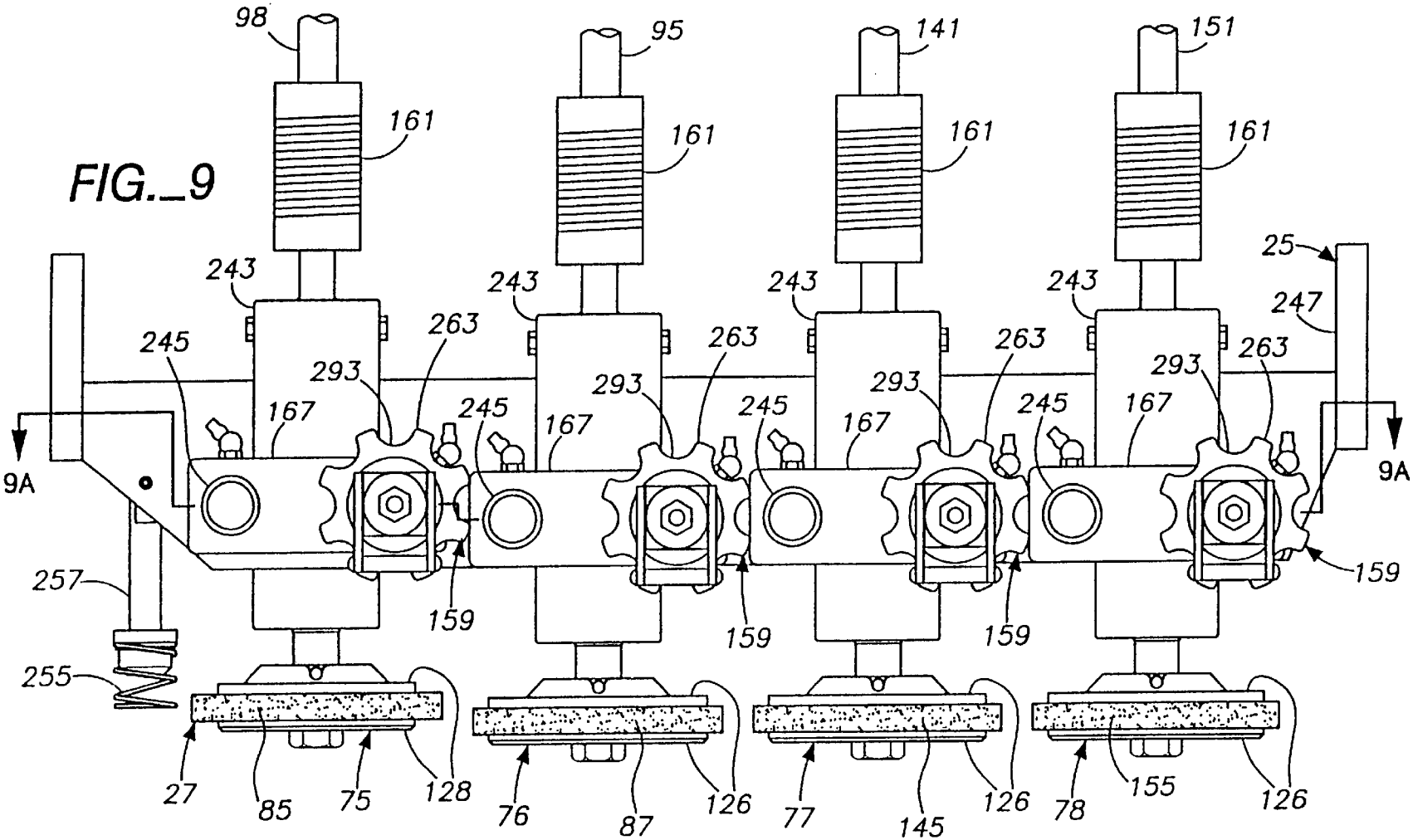
FIG. 9 is a front elevational view of the cap tightening and torquing mechanism in accordance with one embodiment of the present invention.
Figure 9A:
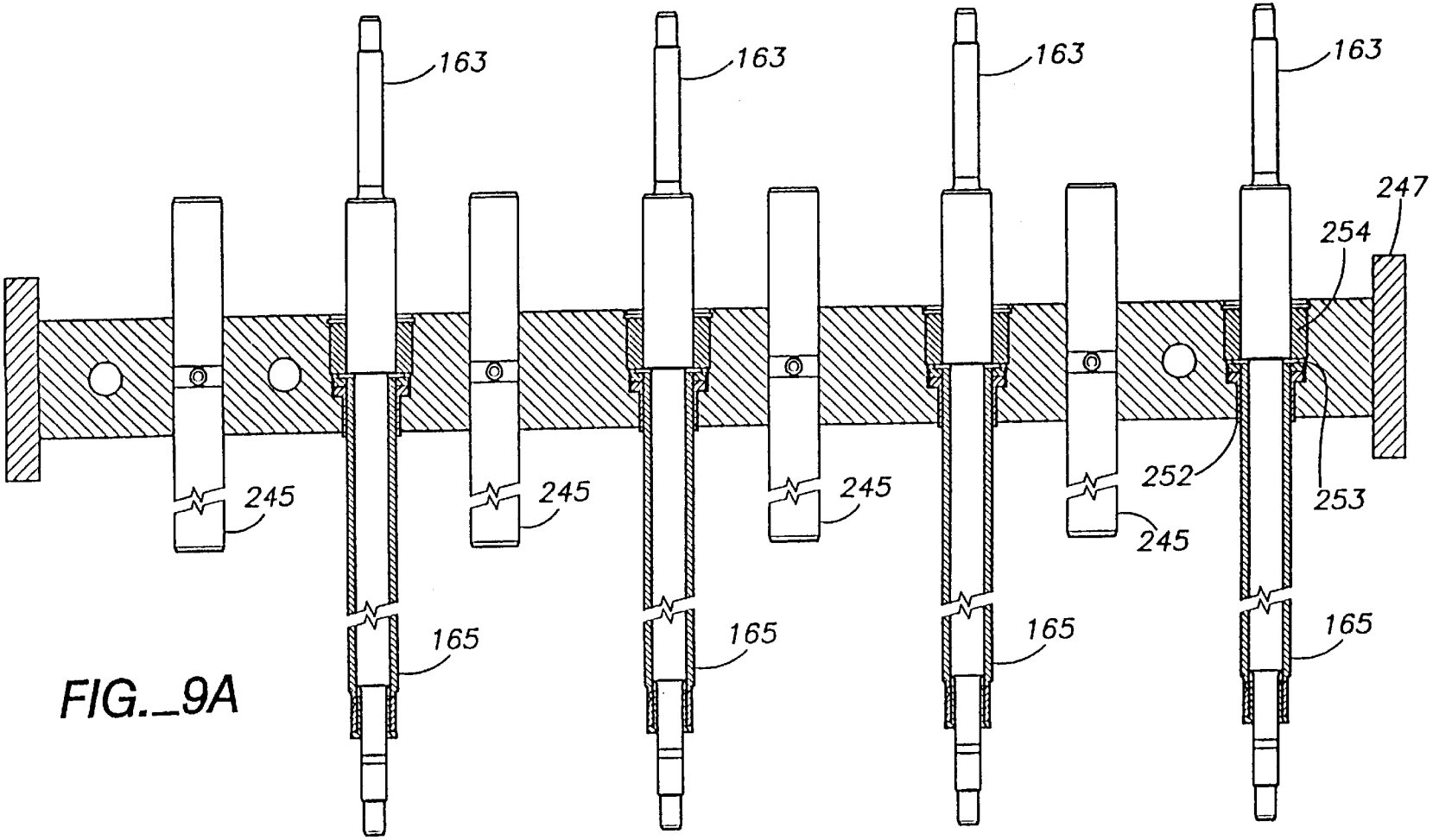
FIG. 9A is a sectional view taken along line 9A—9A in FIG. 9 with some of the adjustment components removed for clarity.

As can best be seen in FIG. 9, first pair of discs 75 is located higher than the remaining pairs of discs to accommodate the height of the cap resting on top of the threads of the container. The remaining pairs of discs are lower to accommodate the height of the cap after it has been threaded down on the container neck. One of ordinary skill in the art will recognize that only two pairs of discs could be used and still accomplish the present invention; the first pair rotates the cap completely down on the threaded neck and the second pair torques the cap tight. Typically, soft rubber discs are used on the first two pairs of discs and harder discs are used on the second two pairs of discs. Center support discs 126 can be used in the second, third and fourth pairs of discs to provide some support to the inside of the rubber discs. Center support discs 128 can be used in the first pair of discs to provide support, however, support discs 128 are smaller in diameter than support discs 126 to allow more flexing of the rubber portion of the disc in the vertical direction which facilitates freedom of movement of the cap down onto the threads. Typically, the first two pairs of discs are softer than the last two pairs of discs. The edges of the discs can be either straight for straight sided caps or beveled for slant sided caps.

Figure 7A:
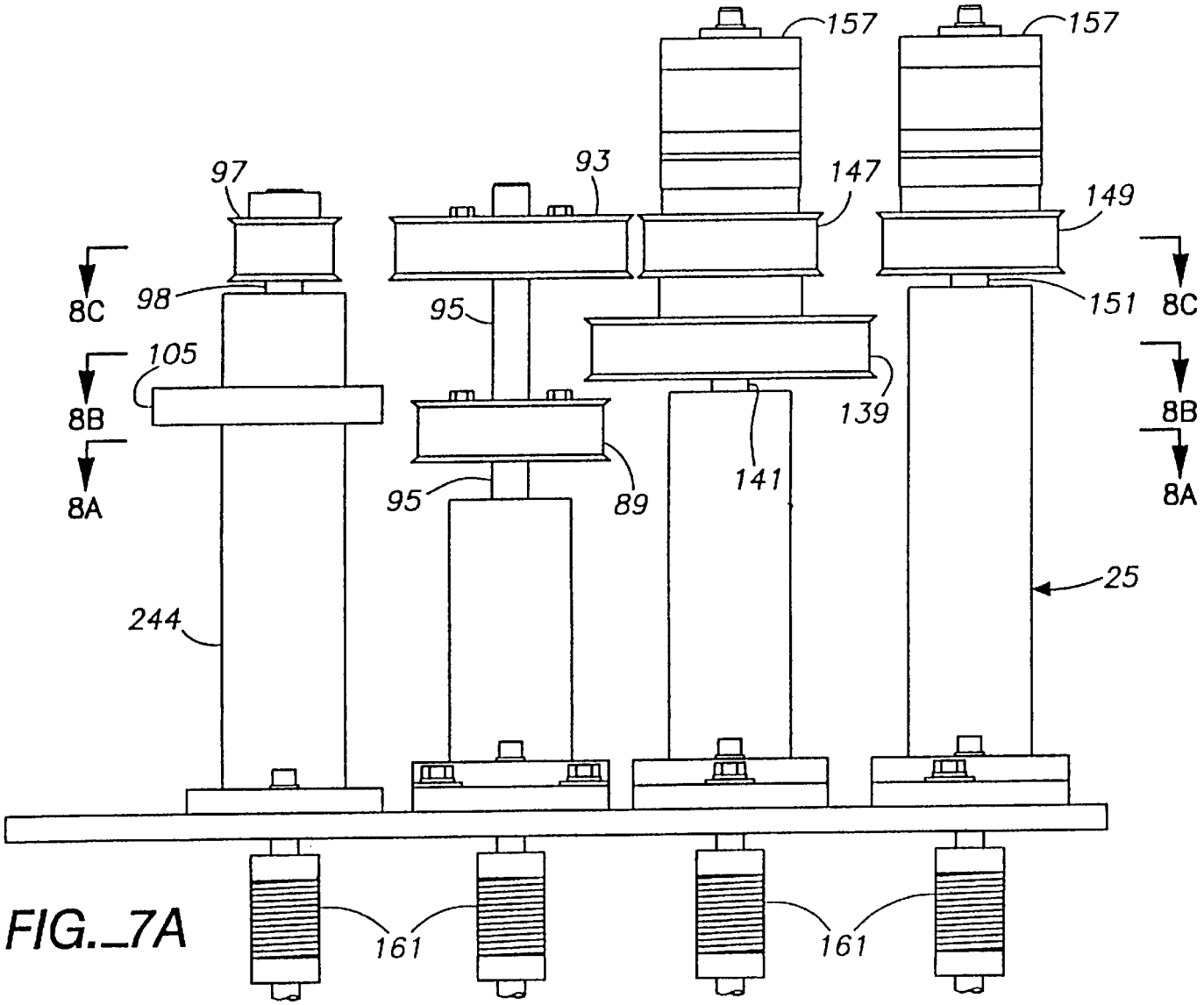
FIG. 7 is a front elevational view of the front capping pulleys in accordance with one embodiment of the present invention.
FIG. 7B is a front elevational view of the rear capping pulleys in accordance with one embodiment of the present invention.
Figure 7B:
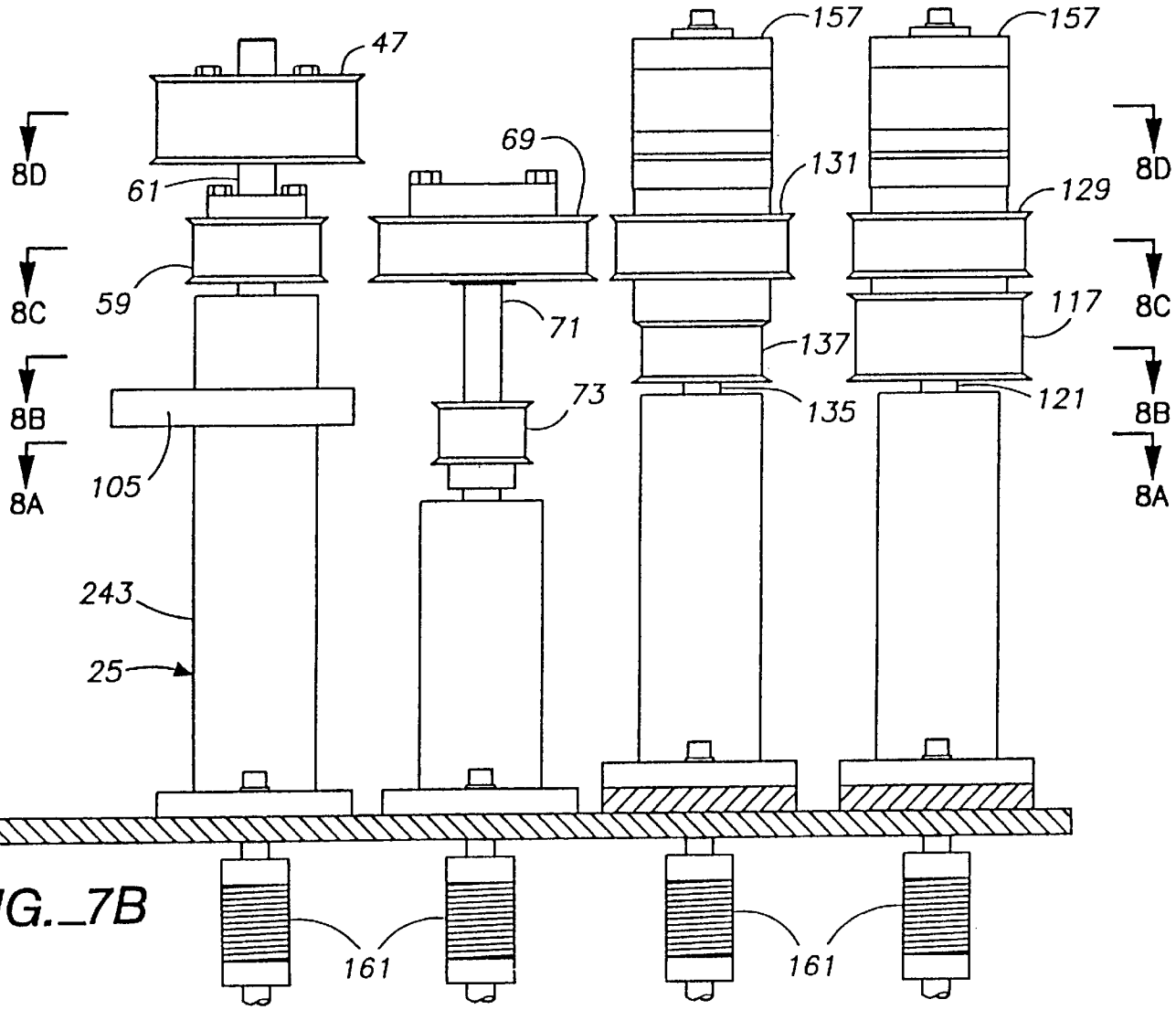
Figure 8A:
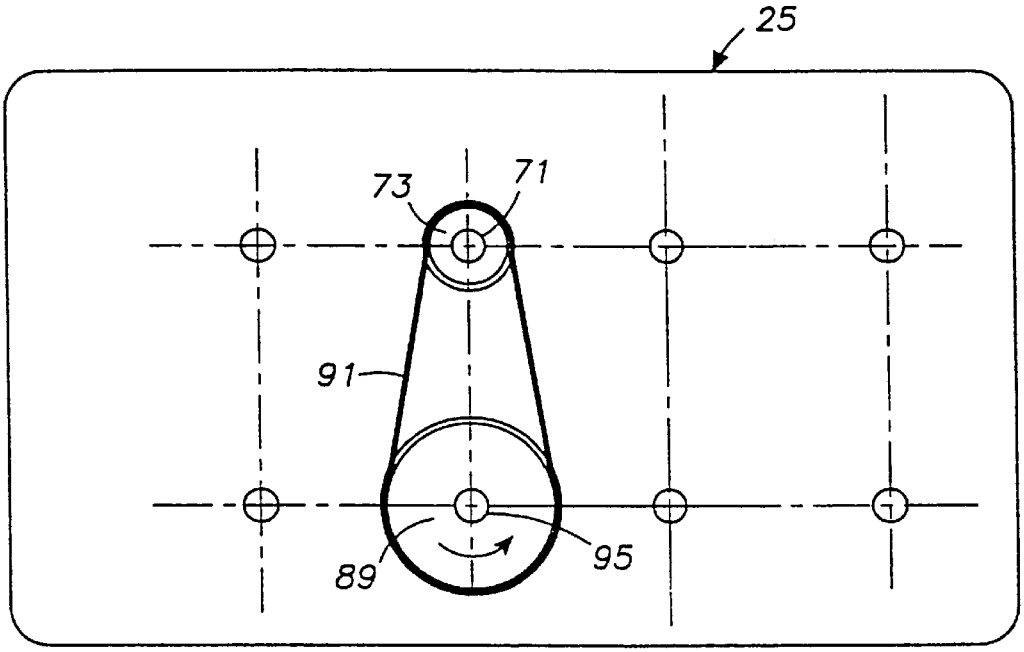
FIG. 8A is a top plan sectional view taken along line 8A—8A in FIGS. 7A and 7B.
Figure 8B:
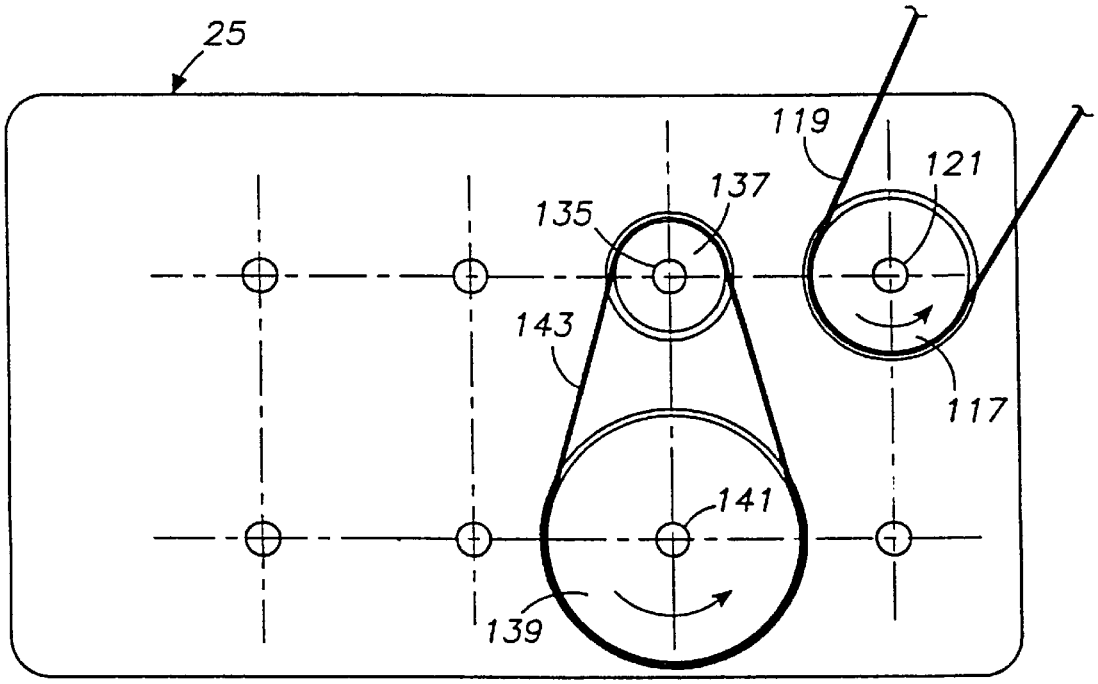
FIG. 8B is a top plan sectional view taken along line 8B—8B in FIGS. 7A and 7B.
Figure 8C:
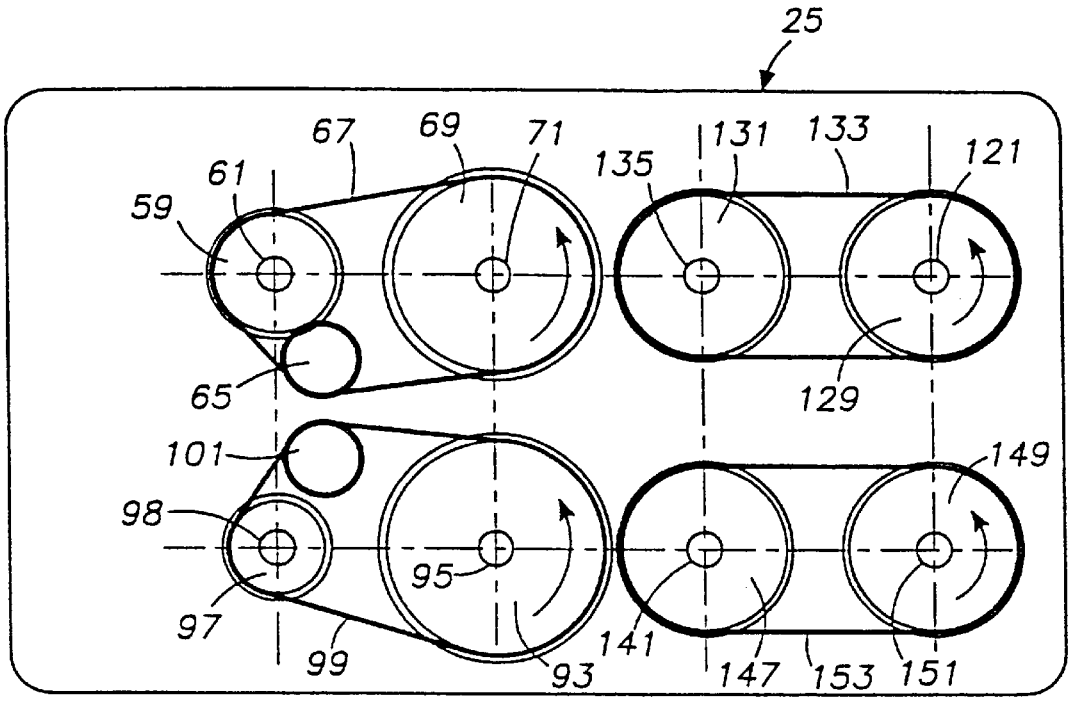
FIG. 8C is a top plan sectional view taken along line 8C—8C in FIGS. 7A and 7B.
Figure 8D:
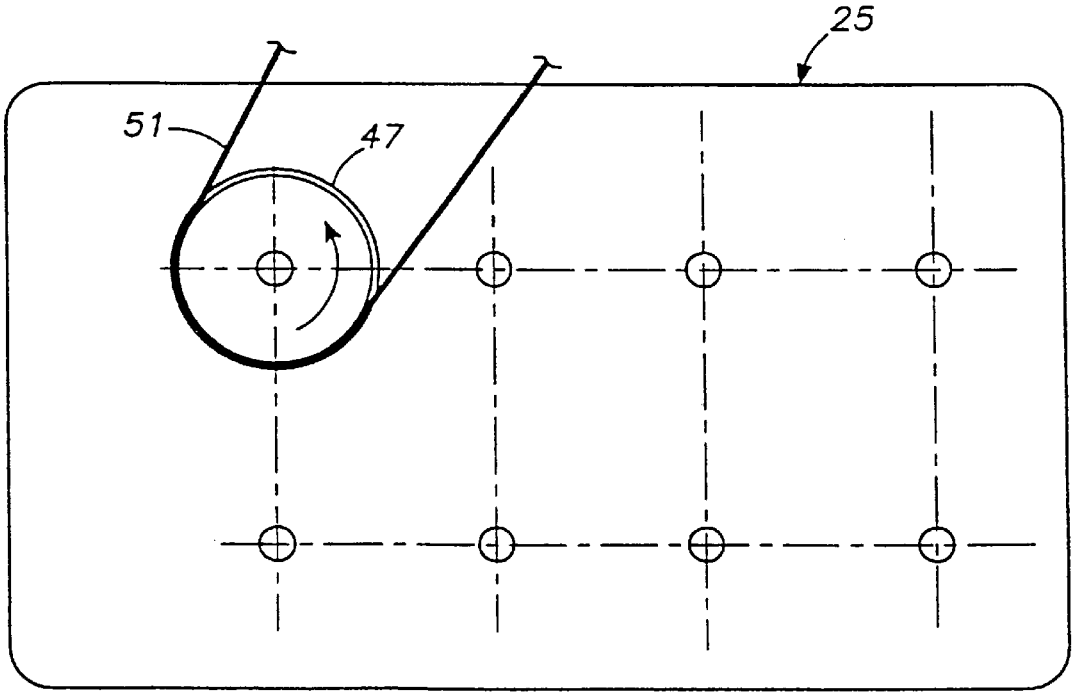
FIG. 8D is a top plan sectional view taken along line 8D—8D in FIG. 7B.

First pair 75 and second pair 76 of discs are connected to main drive motor 110, along with the container grasping belts described above (FIGS. 5 and 6). Third pair 77 and fourth pair 78 are connected to motor 31 as will be described in more detail below. Main drive motor 110 transmits torque to the first and second pair of discs through a series of pulleys (or sprockets) and shafts. Pulley 33 attached to shaft 7 transmits the output speed of main drive motor 110 to pulley 35 through endless belt 37. As discussed above, the output speed of main drive motor 110 is 902.845 revolutions per minute for illustration purposes. One example of an acceptable drive motor for use with the present invention is a 2 horsepower, 480/230 VAC, 3 phase, 60 hz TEFC. Pulley 33 and 35 are of equal diameter so that there is a 1:1 ratio between the two pulleys and thus no speed reduction. Pulley 35 transmits torque to pulley 43 through 1:1 angle gear 45. Pulley 43 is connected to pulley 47 through endless belt 51. Pulley 47 has a slightly smaller diameter than pulley 43 so that there is a 1:1.15 ratio between the two pulleys resulting in a speed increase to 1041.745 revolutions per minute. Pulley 47 is mounted on shaft 61 along with pulley 59 and first rear row capping disc 63. Therefore, first rear row capping disc 63 has a rotational speed of 1041.745 revolutions per minute for a disc diameter of 4 inches. In one embodiment, belt tightening pulley 65 can be provided. Pulley 65 can be adjusted to take out slack that may develop in endless belt 67. Pulley 65 mounted on shaft 102 mounted in adjustable clamp 105 can be adjusted to take out slack that may develop in endless belt 67 by rotating clamp 105 about bearing housing 243 (FIG. 7B).

Endless belt 67 connects pulley 59 to pulley 69. Pulley 69 is mounted on shaft 71 along with pulley 73 and second rear row capping disc 83. Generally, second rear row capping disc 83 does not need to rotate as fast as first rear row capping disc 63 because the cap is already rotated completely or almost completely down on the container threads after leaving first pair 75 of discs. In one embodiment, pulley 69 is larger in diameter than pulley 59 resulting in a 1:0.61 ratio between the two pulleys and a rotational speed of second rear row capping disc 83 of 636.622 revolutions per minute.

An important advantage of the present invention is accomplished by synchronizing the rotation of the first rear row capping disc 63 to the first front row capping disc 85 and second rear row capping disc 83 to second front row capping disc 87. In other words, a change in the speed of the rear row capping discs will necessarily result in the same change in speed, relatively speaking, of the front row capping discs. One method of accomplishing this is to connect pulley 73 to pulley 89 through endless belt 91. Pulley 89, second front row capping disc 83 and pulley 93 are mounted on shaft 95. Pulley 89 has a larger diameter than pulley 73 so that there is a speed reduction between second rear row capping disc 83 and second front row capping disc 87. The ratio between pulley 73 and pulley 89 is 1:0.469 resulting in a rotational speed of second front row capping disc 87 of 298.417 revolutions per minute.

Pulley 93 is connected to pulley 97 mounted on shaft 98 through endless belt 99. In order to accomplish the same relationship between first rear row capping disc 63 and first front row capping disc 85 as exists between second rear row capping disc 83 and second front row capping disc 87, pulley 97 is smaller in diameter than pulley 93 establishing a ratio of 2.35:1 resulting in a rotational speed of 702.157 revolutions per minute for first front row capping disc 85. As before, belt tightening pulley 101 mounted on adjustable shaft 103 mounted in clamp 105 can be provided. Pulley 103 can be adjusted to take out slack that may develop in endless belt 99 by rotating clamp 105 about bearing housing 244 (FIG. 7A).

Disc Speed Ratio Theory

An important advantage of the present invention is achieved by synchronizing the operation of the container grasping belts, the front row capping disc and the corresponding rear row capping disc. In other words, a change in the speed of the container grasping belts will necessarily result in the same change in speed, relatively speaking, of the front row and corresponding rear row capping discs. To apply the caps to the threaded containers and prevent cocked, scuffed and/or loose caps, the present invention synchronizes and ensures the maintenance of an important relationship between these elements no matter what operating line speed (or container grasping belt speed) is used. For our illustrative speed of 170 feet per minute, a difference of about 340 revolutions per minute is maintained between the first front row capping disc and the first rear row capping disc, and the second front row capping disc and the second rear row capping disc with the rear row capping discs rotating faster than the front row capping discs. The front cap tightening disc, the rear cap tightening disc and the container grasping mechanism are synchronized to ensure that the tangential velocity of the rear cap tightening disc minus the tangential velocity of the front cap tightening disc is about twice the predetermined velocity of the container passing through the apparatus. The best results are achieved when the tangential velocity of the rear cap tightening disc minus the tangential velocity of the front cap tightening disc is exactly twice the velocity of the container passing through the capping machine, however acceptable results are achieved when the tangential velocity of the rear cap tightening disc minus the tangential velocity of the front cap tightening disc is 1.9 times (or greater) the velocity of the container passing through the capping machine or when the tangential velocity of the rear cap tightening disc minus the tangential velocity of the front cap tightening disc is 2.1 times (or less) the velocity of the container passing through the capping machine (in other words +5%), therefore, maintenance of about two times the container velocity is sufficient. One method of ensuring this relationship is to use the same drive motor to run the grasping belts and the cap tightening discs, however, other methods can be used to ensure the same result.

The premise of the disc speed ratio theory is to impart equal tangential velocities onto the cap by the front row of discs and the rear row of discs of each of the cap tightening disc pairs. When the proper ratio is achieved, the scuff on the cap will be minimized, loose and/or cocked caps are eliminated, and the capping machine will be set to deliver the lowest range of on-torque.

The best method to understand the disc speed ratio theory is to visualize yourself on the cap of the container being conveyed along the conveyor belt at constant velocity (Vc). You look forward and see a "disc pair," a disc on the left and a disc on the right side of the conveyor belt. The tangential velocity imparted onto the cap by the right side disc (i.e., the front row disc) is defined as Vcap-o. The tangential velocity imparted to the cap by the left side disc (i.e., the rear row disc) is Vcap-i. The disc on the right is on the operator side of the capping machine and has a tangential velocity of Vo. The disc on the left is on the back side of the capping machine and has a tangential velocity of Vi. Mentally place a mark on the outside edge of each disc. As you approach the disc pair, you see the mark on the front row disc traveling toward you with a tangential velocity of Vo. This tangential velocity is in the opposite direction of the velocity of the conveyor (Vc). The mark on the rear row disc is traveling in the same direction as you, but has a greater tangential velocity (Vi). Therefore as you pass through the disc pair the tangential velocity imparted onto the cap by the front row disc (Vcap-o) is the cap velocity (conveyor velocity Vc) added to the tangential velocity of the front row disc. The tangential velocity imparted onto the cap by the rear row disc (Vcap-i) is the cap velocity (Vc) subtracted from the tangential velocity of the rear row disc.

Algebraic equations for the disc speed ratio are as follows:

$$Vcap\text{-}o = Vo + Vc \quad [1]$$

$$Vcap\text{-}i = Vi - Vc \quad [2]$$

To achieve optimization of the capping machine Vcap-o must equal Vcap-i:

$$Vcap\text{-}o = Vcap\text{-}i \quad [3]$$

Substituting equations [1] and [2] into equation [3] yields:

$$Vo + Vc = Vi - Vc \quad [4]$$

Collecting like terms in equation [4] yields:

$$2Vc = Vi - Vo$$

Therefore:

The conveyor belt velocity must be equal to ½ the difference between the rear row disc tangential velocity and the front row disc tangential velocity. Or in other words, the difference between the disc tangential velocities should be about twice the conveyor (i.e., gripper belt and/or container) velocity.

Cap Torquing Mechanism

Third pair 77 and fourth pair 78 of discs are connected to motor 31 (e.g., 0.75 horsepower motor). Drive motor 31 transmits torque to the third and fourth pair of discs through a series of pulleys and shafts. Pulley 107 attached to shaft 109 transmits the output speed of drive motor 31 to pulley 117 mounted on shaft 121 through endless belt 119. Speed reducer 123 is a 5:1 ratio speed reducer. The output speed of drive motor 31 is 1750 revolutions per minute for illustration purposes, therefore pulley 107 rotates at 350 revolutions per minute. Pulley 117 is of slightly smaller diameter than pulley 107 resulting in a 1:1.818 ratio therefore pulley 117 rotates at about 640 revolutions per minute for our illustrative speed. Fourth rear row torquing disc 125 is also connected to shaft 121 and rotates at about 640 revolutions per minute.

Pulley 129 mounted on shaft 121 transmits torque to pulley 131 mounted on shaft 135 through endless belt 133. Pulley 129 and pulley 131 are of equal diameter therefore rotate at the same speed due to the 1:1 ratio. Pulley 137 mounted on shaft 135 transmits torque to pulley 139 mounted on shaft 141 through endless belt 143. Pulley 139 is of larger diameter than pulley 137 thus creating a speed reduction between third rear row torquing disc 127 and third front row torquing disc 145 which is connected to shaft 141. Pulley 147 also connected to shaft 141 transmits torque to pulley 149 and fourth front row torquing disc 155 mounted on shaft 151 through endless belt 153. Pulley 147 and pulley 149 are of equal diameter therefore rotate at the same speed due to the 1:1 ratio.

The ratios between third front row torquing disc 145 and third rear row torquing disc 127, and between fourth front row torquing disc 155 and fourth rear row torquing disc 125 are fixed at a ratio of 2.286:1 for illustrative speed due to pulley 139 being larger in diameter than pulley 137. However this ratio is not critical, although it is important to have the rear disc rotate faster than the front disc. In one embodiment, the speed of the third and fourth front row discs are generally the same as are the speeds of the corresponding rear discs. Generally, for our illustration speed of 170 feet per minute, the maximum speed of the third and fourth front discs is 280 revolutions per minute and, therefore, the maximum speed of the corresponding rear discs is 640 revolutions per minute.

Disc Speed Versus Off-Torque:

Off-torque is very important in the container industry. Off-torque is the amount of torque that is required to remove a cap or lid from a container. The generation of a desired level of off-torque in a capping operation is the result of transferring rotational energy stored in pairs of rotating discs to the caps on the containers (after they have been turned down on the threaded neck of the container) through short duration contact with the spinning discs. The available inertial energy increases as the square of the rotational speed of the discs. In other words, doubling the speed will make four times the energy available.

Running the containers through the capping machine at production line operating speeds gives the cap very little time in contact with each pair of discs in which to reach the desired torque. Therefore, the inertial energy of the rotating discs is used to instantaneously deliver torquing energy to the cap. The delivery of inertial torquing energy to the cap by the spinning discs is much less effected by the time in contact with the cap than is the energy delivered by the clutch action. Therefore, at typical line speeds at which containers are run, if the disc speeds, air pressures in the clutches and disc pressures against the cap are kept the same, the gripper belt speed does not seem to make much difference in the applied torque. In other words, the off-torque appears to be more or less independent of gripper belt and conveyor speed (i.e., speed of the containers moving through the machine). You will get much the same torque for a given disc speed at 80 feet per minute as you will at 160 feet per minute.

Clutch Air Pressure:

Each of the first row capping discs and rear row capping discs can be equipped with an air clutch 157 to prevent over-torquing and scuffing of the caps. Likewise, each of the first row torquing discs and rear row torquing discs can be equipped with an air clutch 157. Air clutch regulators and gages 213 are located near the operator side of the capping machine to provide clear visual access. The clutches are not intended to be used to set off-torque. Their proper function is to allow the cap to escape the grip of the discs without scuffing or excessive disc wear and to get the discs back up to shaft operating speed before the discs make contact with the next cap. In general, the clutches operate at 8 or 9 psi while applying 17 to 20 in-lbs on-torque (which yields 12 to 15 in-lbs off-torque). If the clutch air pressure is set too high, cap scuffing will result. Because clutches are installed on both front and rear disc shafts, cap scuffing can almost completely be eliminated by correct air pressure settings. In general, the correct settings of clutch pressures will have the rear clutches set from one to two psi higher than the front clutches.

How tight the discs are set against the caps with the quill adjustment knobs (to be discussed below) has a major effect on the torque achieved. The tighter the discs are squeezed against the cap, the longer the discs will be in contact with each cap. Also the torque is transmitted better to the cap the tighter the discs grip the cap. This is important because large changes can be made in high-end torque such as going from 20 in-lbs to 40 in-lbs off-torque by tightening the quill adjustments in against the caps. However, with soft caps, too tight a grip by the discs will cause excessive friction between the cap and the finish threads which may actually reduce the off-torque. It is best to operate with the least disc pressure on the caps that will still provide the desired off-torque. This generally reduces problems of container misaligment in the capper, jams, etc.

Quill Adjustment

Figure 10:
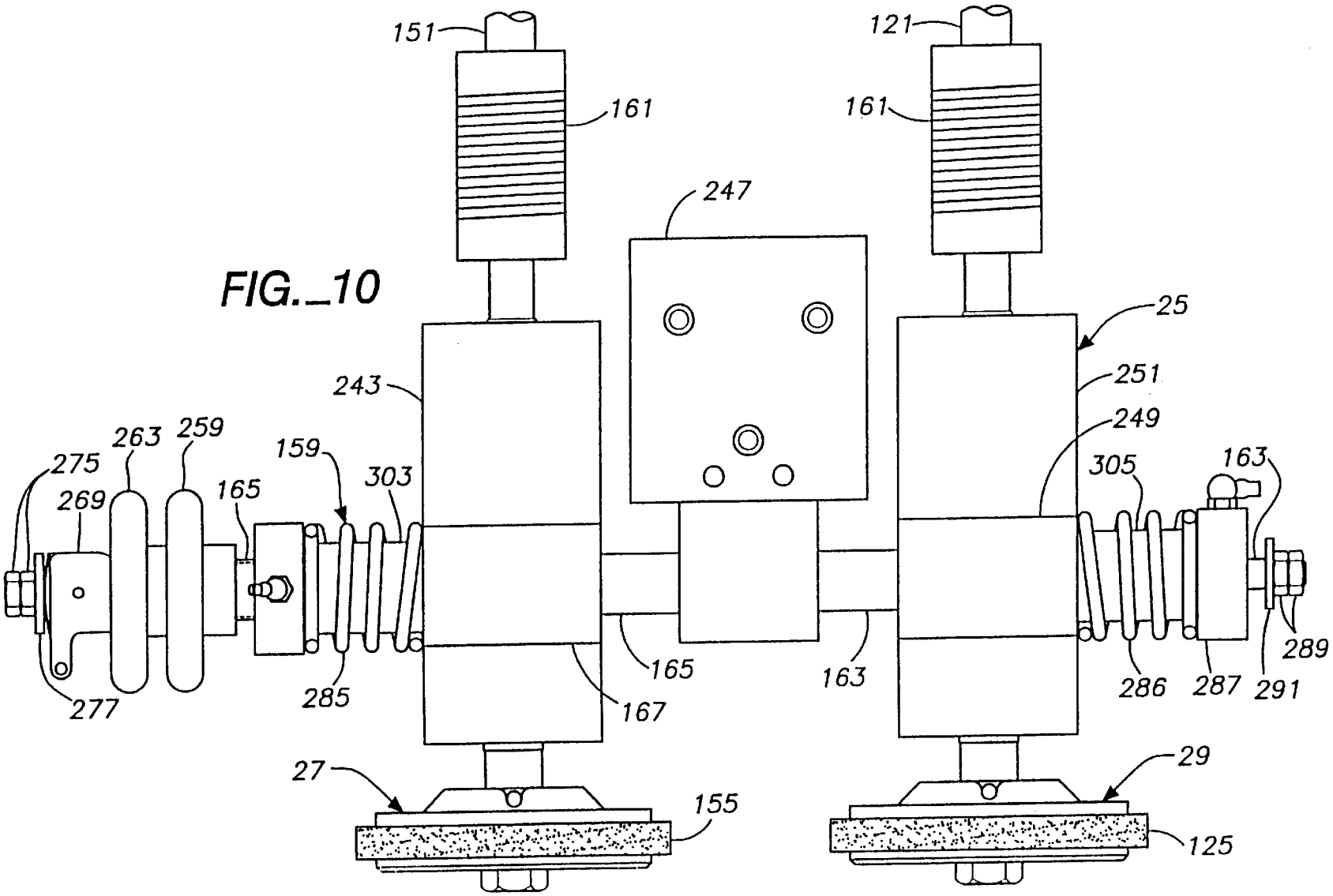
FIG. 10 is a right side elevational view of the cap tightening and torquing mechanism of FIG. 9.
Figure 10A:
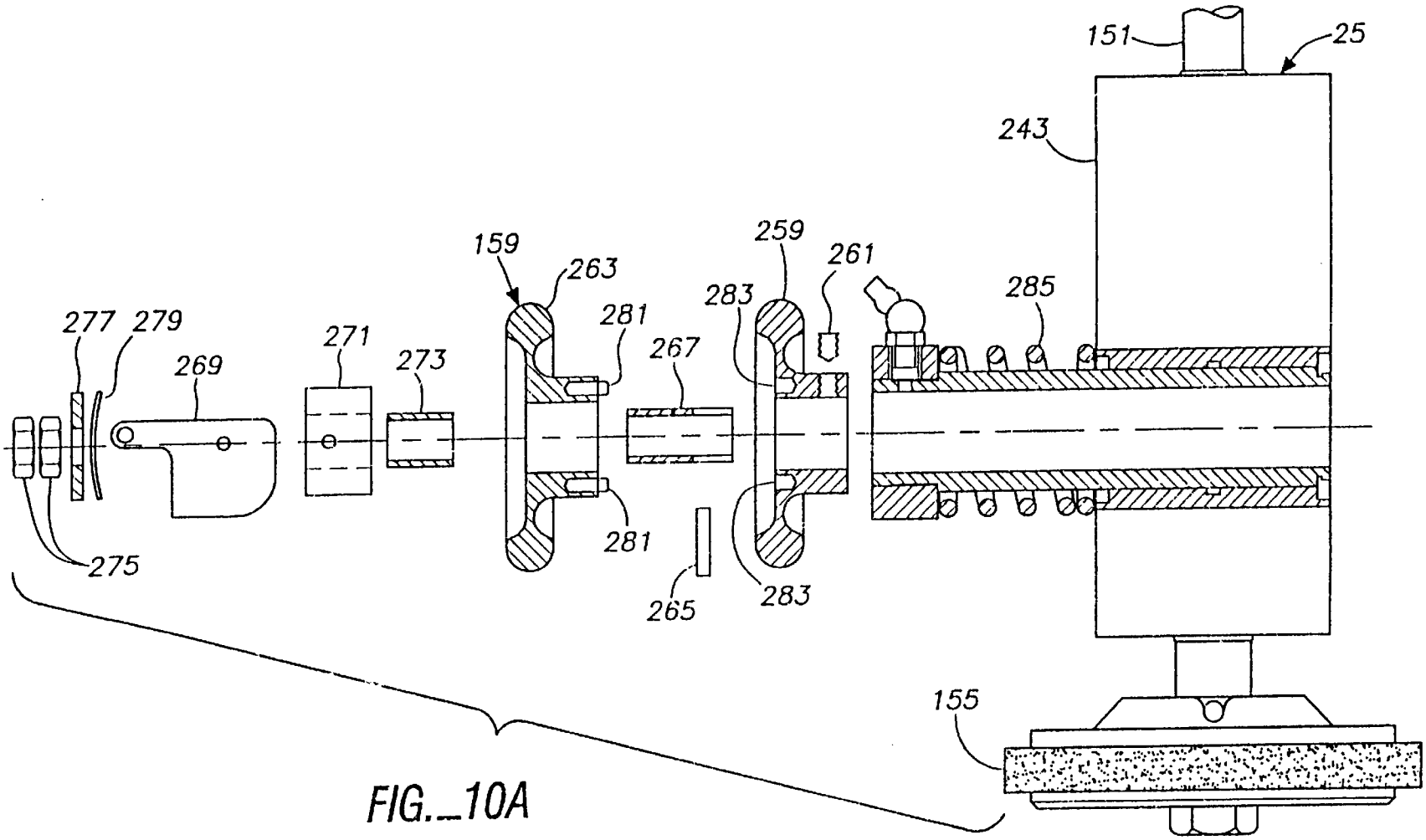
FIG. 10A is an exploded partial cross-sectional view of the adjustment mechanism for the cap tightening and torquing mechanism in accordance with one embodiment of the present invention.

In order that the machine may be used to apply different diameter caps and so that the torque can be adjusted, the front disc and rear disc of each pair are adjustable so as to be closer together or further apart. This is accomplished by quill adjustment mechanisms 159 associated with each pair of discs (FIGS. 9–10A). Spring 255 and spring guide 257 can be provided to bias a tongue (not shown) onto the top of the caps to hold the caps stable just after the caps exit the cap chute discussed above and before the caps enter the first set of rotating discs. Each disc driving shaft has at least one flexible coupling 161 to accommodate adjustments made with the quill adjustment mechanisms.

The quill adjustment mechanisms are comprised principally of two coaxial shafts 163 and 165 being supported rotatably free in front bearing blocks 167, quill mounting bracket 247, and rear bearing blocks 249. Front bearing blocks 167 are mated with and extend through each of the respective front quill housings 243 associated with the front row capping discs. Rear bearing blocks 249 are mated with and extend through each of the respective rear quill housings 251 associated with the rear row capping discs. Each of the disc rotating shafts 98, 95, 141 and 151 extend rotatably free through the center of their respective front quill housings 243. Likewise, each of the disc rotating shafts 61, 71, 135 and 121 extend rotatably free through the center of their respective rear quill housings 251.

Coaxial shafts (i.e., quill housing adjustment shafts) 163 and 165 pass through each respective front bearing block 167 on one end (in one embodiment on the right side) of the quill housing and guide bars 245 pass through each respective front bearing block 167 on the other end of the quill housing and on through to each of the respective rear bearing blocks 249 with the disc rotating shaft passing vertically therebetween (FIG. 9). Bearings 252, 253 and 254 located in front quill mounting bracket 247 associated with each set of coaxial shafts allow the shafts to rotate freely therein.

Two adjustment knobs are associated with the pair of coaxial shafts. Adjustment knob 259 is attached to quill housing adjustment shaft 165 by set screw 261. When adjustment knob 259 is rotated (thus adjustment shaft 165 rotates), front quill housing 243 is moved forward or rearward. Adjustment knob 263 is attached to quill housing adjustment shaft 163 by pin 265 inserted in slotted bushing 267. Slotted bushing 267 allows knob 263 to slide endwise along shaft 163 as will be described in more detail below. Cam lock 269 mounted on cam lock pivot 271 and bushing 273 attaches to the end of shaft 163 and is held in place by jam nuts 275, washer 277 and spring washer 279. At the other end, spring collar 287 is attached to the end of shaft 163 by nuts 289 and washer 291.

When cam lock 269 is in its locked position (FIG. 10) then pins 281 extending from knob 263 engage cavities 283 in knob 259 thus locking both adjustment knobs (thus both shafts) together. With the two knobs locked together, counter-clockwise rotation of either knob will cause front quill housing 243 and rear quill housing 251 (thus disc 155 and disc 125) to move closer together to accommodate smaller size caps. With the two knobs locked together, clockwise rotation of either knob will cause front quill housing 243 and rear quill housing 251 to move farther apart to accommodate larger size caps. Sleeve 303 is slidably received in quill housing 243. Biasing means (i.e., compression spring) 285 provides resistance against quill housing 243 to oppose movement of the quill housing. In this way, the biasing means absorbs the shock of a misaligned cap or other problem with the cap and/or container when the cap hits the pair of disks. Similarly, sleeve 305 is slidably received in quill housing 251 such that biasing means 286 operates in a like manner. In general, biasing means 285 and 286 are relatively stiff so as to deflect only in the event of large impacts. Typically, the quill housings of the first two pairs of discs have biasing means 285 and 286 and in the last two pairs of discs the biasing means is replaced with a solid cylindrical element so that those quill housings cannot deflect.

When cam lock 269 is in its unlocked position (FIG. 10A) then knob 263 can be slid endwise along shaft 163 away from knob 259 thus disengaging pins 281 from cavities 283. With the two knobs unlocked and separated one from the other, clockwise rotation of knob 263 will cause rear quill housing 251 (thus disc 125) to move away from the centerline passing lengthwise through the capping machine (i.e., further from to the centerline of the conveyor). Counter-clockwise rotation of knob 263 will cause rear quill housing 251 to move closer to the centerline of the capping machine. With the two knobs unlocked and separated one from the other, clockwise rotation of knob 259 will cause front quill housing 243 (thus disc 155) to move farther away from the centerline of the capping machine. Counter-clockwise rotation of knob 259 will cause front quill housing 243 to move closer to the centerline of the capping machine.

All of these movements facilitate a great number of adjustments. With respect to all four pairs of discs, they can be adjusted separately to: accommodate larger or smaller size caps; accommodate container necks slightly off the center line of the conveyor; etc. With respect to the last two pair of discs (i.e., the torquing discs), the adjustments can be used to vary the amount of torque applied to the caps. The amount of tightness of the discs against the cap has a major effect on the torque achieved. The tighter the discs are against the caps, the longer the discs will be in contact with each cap. In addition, the tighter the discs grip the cap, the better the torque is transmitted to the cap. However, the discs should not be too tight because excessive friction between the cap and the threads will be created which may actually reduce the off-torque.

Once all of the pairs of discs are adjusted properly, a knob locking bar 295 (FIG. 3) can be provided to prevent adjustment knobs 259 and 263 from rotating. Typically, the knob locking bar spreads the length of all of the pairs of discs and attaches to quill mounting bracket 274 with two locking bar shafts 297 perpendicular to and located at either end of the knob locking bar. The locking bar shafts extend slidably free through bearing mounts 299 that are attached to quill mounting bracket 274. Thus, the knob locking bar is free to slide forward (toward the operator) or backward. The knob locking bar is located above each of the pairs of adjustment knobs. Four protrusions 301 extend from the bottom of the knob locking bar so that when the locking bar is slid forward the protrusions engage with grooves 293 on each of adjustment knobs 259 and 263 to keep the knobs from rotating during the operation of the machine or to keep the knobs from being inadvertently rotated.

Brief Summary of Operation

Caps 16 are fed from hopper 12 into inclined chute 17 with the threaded openings of each cap facing downward. At the same time, containers 40 are advanced on conveyor belt 3 through capping machine 1. The cap at the lowermost end of chute 17 is pulled out of the chute by each passing container; by the cap lip hooking over the container upper edge. The container with the cap thus loosely placed thereon advances so that it is grasped between grasping belts 49 which prevent the containers from rotating while advancing through the capping machine along the conveyor belt. As the container advances, the cap moves between first pair 75 of rotating discs that turn the cap so as to thread it down on the container neck threads. Then the container advances through the second pair 76 of rotating discs which ensure the cap is turned all the way down on the threads (and in most cases, impart light off-torque to the cap). When the container reaches third pair 77 of rotating discs, third pair 77 impart torque to the cap to seal it down on the threads. Fourth pair 78 of rotating discs ensure the cap has the desired off-torque before the container with the cap sealed thereon exits the capping machine.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed without departing from the spirit of the present invention, and it is expressly intended that all such variations, changes and equivalents which fall within the spirit and scope of the present invention as defined in the claims be embraced thereby.

The invention claimed is:

1. A safety apparatus for use with an apparatus having a container grasping mechanism that moves a container through the apparatus, the safety apparatus comprising:

an inlet guard located upstream of the container grasping mechanism; and a stopping mechanism associated with the inlet guard such that if the inlet guard is displaced with respect to the container grasping mechanism when the apparatus is operating the stopping mechanism stops the movement of the container grasping mechanism to prevent an operator from being injured in the apparatus.

2. The apparatus of claim 1 wherein the inlet guard is pivotally attached to the apparatus such that the inlet guard can be rotated clear of the container grasping mechanism in order to adjust the apparatus.

3. The apparatus of claim 1 wherein the stopping mechanism comprises:

a shaft extending out of the apparatus and having a safety switch attached thereto;

an arm having the inlet guard attached to its distal end and being mounted at its proximal end to the shaft such that when the arm is displaced toward the container grasping mechanism when the apparatus is operating the safety switch stops the movement of the container grasping mechanism.

4. The apparatus of claim 3 wherein the inlet guard comprises:

a weldment pivotally attached to the distal end of the arm such that the weldment can be rotated between an operating position which prevents the operator from being pulled into the container grasping mechanism and a non-operating position that allows access to the container grasping mechanism.

* * * * *